US005784674A

United States Patent [19]

Iseki et al.

[11] Patent Number: 5,784,674

[45] Date of Patent: Jul. 21, 1998

[54] INNER FACE CLEANING MEMBER FOR AN INTERMEDIATE TRANSFER DEVICE

[75] Inventors: Shuji Iseki; Norio Hokari; Yukio Hayashi; Junichirou Sameshima; Mikio Kobayashi; Ryoichi Tsuruoka, all of Ebina, Japan

[73] Assignee: Fuji Xerox Co., Ltd., Tokyo, Japan

[21] Appl. No.: 669,725

[22] Filed: Jun. 26, 1996

[30] Foreign Application Priority Data

| | | | |
|---|---|---|---|
| Jun. 29, 1995 | [JP] | Japan | 7-164303 |
| Jun. 30, 1995 | [JP] | Japan | 7-166688 |
| Jun. 30, 1995 | [JP] | Japan | 7-166689 |
| Jun. 30, 1995 | [JP] | Japan | 7-166690 |

[51] Int. Cl.[6] ..... G03G 21/00

[52] U.S. Cl. ..... 399/297; 399/299; 399/354

[58] Field of Search ..... 399/297, 299, 399/353, 254

[56] References Cited

FOREIGN PATENT DOCUMENTS

| | | |
|---|---|---|
| A-1-177578 | 7/1989 | Japan . |
| A-4-109282 | 4/1992 | Japan . |
| A-4-134390 | 5/1992 | Japan . |
| A-4-166957 | 6/1992 | Japan . |
| A-5-11631 | 1/1993 | Japan . |
| A-5-100577 | 4/1993 | Japan . |
| A-6-83210 | 3/1994 | Japan . |
| 7-104611 | 4/1995 | Japan . |

*Primary Examiner*—Nestor R. Ramirez

*Attorney, Agent, or Firm*—Oliff & Berridge, PLC

[57] ABSTRACT

An image formation apparatus for forming an image includes an endless belt member and an inner face cleaning member which is provided on an inner face of the endless belt member. The cleaning member captures deposits deposited on the inner face of the endless belt member and holds the captured deposits. The inner face cleaning member includes fibers densely arranged and projecting radially outward from the inner face cleaning member. The inner face cleaning member is fixed in a contact state so that a contact face does not move while the endless belt is moving.

13 Claims, 27 Drawing Sheets

INNER FACE CLEANING MEMBER FOR AN INTERMEDIATE TRANSFER DEVICE

BACKGROUND OF THE INVENTION

This invention relates to an image formation apparatus such as a copier, a printer, or a facsimile using an electrophotographic apparatus and more particular to an image formation apparatus which has members shaped like endless belts such as a photosensitive belt, a transfer belt, and an intermediate transfer belt.

In recent years, color printing of documents processed in offices, etc., has been rapidly increasing and image formation apparatuses such as copiers, printers, and facsimiles for handling the documents have also been equipped with a color printing capability explosively. At present, the color machines tend to provide high image quality and operate at high speed with high quality and speedup of business processing in offices, etc. As a color machine to meet such requirements, for example, a so-called tandem color image formation apparatus is already proposed and is brought to the commercial stage. It has image formation units in a one-to-one correspondence with colors of black (K), yellow (Y), magenta (M), and cyan (C) and executes multiple transfer of images different in color formed by the image formation units onto a transfer medium or an intermediate transfer body held and transported on a transfer belt shaped like an endless belt for forming a color image.

For example, the following is available as such a tandem color image formation apparatus: As shown in FIG. 17, the tandem color image formation apparatus comprises four color image formation units of a black image formation unit 100K for forming a black (K) image, a yellow image formation unit 100Y for forming a yellow (Y) image, a magenta image formation unit 100M for forming a magenta (M) image, and a cyan image formation unit 100C for forming a cyan (C) image, which are spaced from each other at give intervals and placed horizontally. Placed below the black, yellow, magenta, and cyan color image formation units 100K, 100Y, 100M, and 100C is a transfer belt 102 shaped like an endless belt for transporting transfer paper 101 across transfer positions of the color image formation units 100K, 100Y, 100M, and 100C with the transfer paper 101 electrostatically attracted. This transfer belt 102 is shaped like an endless belt by forming, for example, an insulating synthetic resin film of polyethylene terephthalate (PET), etc., having flexibility like a band and connecting both ends of the synthetic resin film formed like a band by means of welding, etc. It is held circulatably by a plurality of rollers including a drive roller and is circulated by the drive roller at a predetermined move speed.

The black, yellow, magenta, and cyan color image formation units 100K, 100Y, 100M, and 100C are the same in configuration and form black, yellow, magenta, and cyan toner images respectively in sequence, as described above. Each of the color image formation units 100K, 100Y, 100M, and 100C comprises a photosensitive drum 103. The surface of the photosensitive drum 103 is uniformly charged by an scorotron 104 for primary charge, then is scanned by and exposed to a laser beam 105 for image formation in response to image information for forming an electrostatic latent image. The electrostatic latent images formed on the surfaces of the photosensitive drums 103 are developed with black toner, yellow toner, magenta toner, and cyan toner by developing units 106 of the color image formation units 100K, 100Y, 100M, and 100C to form visible toner images, which then are before-transfer charged by before-transfer chargers 107, then charged by transfer chargers 108 for transfer to the transfer paper 101 held on the transfer belt 102 in sequence. The transfer paper 101 to which the black, yellow, magenta, and cyan toner images have been transferred is detached from the transfer belt 102, then is fixed by a fuser (not shown) for forming a color image.

Further, the transfer paper 101 is supplied from a paper feed cassette (not shown) and is transported on the transfer belt 102 at a predetermined timing by a resist roller 115. It is also held and transported on the transfer belt 102 by a paper holding charger (not shown) and a charge roller (not shown).

In FIG. 17, numeral 109 denotes a photosensitive body cleaner, numeral 110 denotes a photosensitive body electricity removal lamp, numeral 111 denotes a paper stripping corotron, numeral 112 denotes a transfer belt electricity removal corotron, numeral 113 denotes a transfer belt cleaner, and numeral 114 denotes a cleaning preprocessing corotron.

By the way, the tandem color image formation apparatus thus configured, which forms one image consecutively by a plurality of image formation units, can operate at a fairly high speed.

However, an image quality defect caused by problems involved in the transfer belt is not yet resolved for the tandem color image formation apparatus.

The problems will be discussed below:

(1) Dirt on rear face of transfer belt

As shown in FIG. 17, since the transfer paper 101 is held by charging the transfer belt 102 by the paper holding charger (not shown) from the rear face of the transfer belt 102 and toner images are transferred by charging the transfer belt 102 by the transfer chargers 108 from the rear face of the transfer belt 102, the transfer belt 102 made of a dielectric substance of an insulating synthetic resin film of PET, etc., remains charged almost all the while until electricity of the transfer belt 102 is removed by the transfer belt electricity removal corotron 112. Thus, substances such as black toner, yellow toner, magenta toner, cyan toner, paper powder of the transfer paper 101, dust, and hairs suspended in the color image formation apparatus are electrostatically attracted to the surface and rear face of the transfer belt 102. Particularly, if suspended substances such as toner and paper powder are attracted to the rear face of the transfer belt 102, uneven transfer is caused when toner images formed on the photosensitive drums 103 are transferred onto the transfer paper 101, or in passage through rollers 116 and 117 for circulating the transfer belt 102, the suspended substances are made to intervene between the transfer belt 102 and the roller 116, 117 or are deposited on the surfaces of rollers 116 and 117, delicately changing the outer diameters of the rollers 116 and 117, thus causing the transfer belt 102 to run on one side along the axial direction (the phenomenon is called a walk phenomenon) and color image registration to shift, impairing the image quality or bringing the edge of the transfer belt 102 into contact with any other member, thereby inviting damage.

Then, to solve the problem, arts disclosed in Japanese Patent Laid Open Nos. Hei 1-177578, 4-109282, 4-134390, 6-83210, etc., are already proposed.

A transfer belt unit according to Japanese Patent Laid Open No. Hei 1-177578 has a transfer belt for transporting transfer material to transfer a toner image between a photosensitive body for supporting the toner image and transfer means opposed to the photosensitive body, a plurality of rollers on which the transfer belt is placed, and cleaning means being opposed to at least one of the rollers with the transfer belt between for cleaning the transfer material transport face of the transfer belt, wherein of the rollers, at least the roller opposed to the cleaning means has roller cleaning means for cleaning the surface of the roller.

An image formation apparatus according to Japanese Patent Laid Open No. Hei 4-109282 has an image support and endlessly moving transport means for transporting a transfer material to the image support to transfer a realized image formed on the image support to the transfer material, wherein the image formation apparatus further includes second cleaning means for cleaning the rear face of the transfer material placement face of the transport means.

An image formation apparatus according to Japanese Patent Laid Open No. Hei 4-134390 comprises cleaning means for cleaning the transfer material placement face and its opposite rear face of an endlessly moving transport belt for transporting a transfer material to transfer a toner image formed on the image support to the image support, wherein each of the cleaning means can be connected to and disconnected from the transport belt.

A transfer unit according to Japanese Patent Laid Open No. Hei 6-83210 has a transfer belt for transporting transfer material to transfer a toner image between a photosensitive body for supporting the toner image and transfer means opposed to the photosensitive body, a plurality of rollers on which the transfer belt is placed, and cleaning means being opposed to at least one of the rollers with the transfer belt between for cleaning the transfer material transport face of the transfer belt, wherein a detachable plate-like blade is abutted against the surface of at least the roller opposed to the cleaning means, of the rollers.

However, the prior arts have the following problem: Since all of the transfer belt unit, the image formation apparatuses, and the transfer unit according the proposals only divert the cleaning means formerly used for cleaning the photosensitive drums to the cleaning means for cleaning the transfer belt and transport belt, suspended substances such as toner, paper powder, and hairs electrostatically attracted to the rear face of the transfer belt as described above cannot be removed.

In more detail, since the cleaning means used with the apparatuses and units according to the proposals are felt material, fur brushes, blades, etc., formerly used for cleaning photosensitive drums, they do not have a function of holding captured suspended substances although they have a function of capturing suspended substances such as toner, paper powder, and hairs attracted to the rear face of the transfer belt. Thus, when the attracted suspended substances once captured by the cleaning means accumulate to a certain degree, they cannot be held on the cleaning means and pass through the cleaning means and again are attracted to the inner face of the transfer belt.

Such a problem can be solved or removed by providing means for removing the attracted suspended substances once captured by the cleaning means therefrom. However, it is difficult to provide means for removing the captured suspended substances from the cleaning means depending on the positional relationship between the cleaning means and the removal means, and it is inevitable to place reliance on the attracted suspended substance holding function of the cleaning means. Since the attracted suspended substance holding function of the cleaning means is insufficient as described above, the problem that when the attracted suspended substances once captured by the cleaning means accumulate to a certain degree, they cannot be held on the cleaning means and pass through the cleaning means and again are attracted to the inner face of the transfer belt, remains unsolved.

(2) Problem caused by unnecessary charge accumulation on both ends of transfer belt In an image formation apparatus adopting belt transport means for transporting a transfer material, a phenomenon in which a belt moves in a direction perpendicular to a transport direction, namely, a snaking phenomenon is caused by parallelism between rolls associated with placement of the rolls on which the belt is placed, the roll column precision, the circumferential length difference on both side ends of the belt, etc., and as the snaking phenomenon occurs, a toner image transferred to transfer material on the belt leans to one side, thus a good image cannot be provided.

Thus, formerly, an apparatus was proposed wherein a belt end guide member pivotally supported movably in a belt axial direction and with a spring intervening between the guide member and a support member is disposed between the side of a tension giving roll and the support member for supporting the roll for elastically supporting the belt end. According to the apparatus, the belt is driven while it is coming in contact with the elastic support guide member; at the time, the guide member moves along asperities on the belt end, thereby controlling the belt snaking.

However, if the image formation apparatus having the tension giving roll provided with the belt end guide member as described above forms images particularly over a long term, trouble caused by an electrostatic action in the belt transport unit (a malfunction, etc.,) occurs even though electricity of the belt is removed in addition to a poor image caused by the above-mentioned belt snaking phenomenon, and another poor image is induced. For the trouble caused by the electrostatic action, study of the present inventor et al. recognizes that insufficient electricity removal of the insulating belt or charge remaining or accumulating in the both end regions of the insulating belt whose electricity is not removed by the belt electricity remover causes electric noise, etc., to occur, whereby trouble such as a malfunction of the apparatus occurs sometimes. Also, the study recognizes that as the number of times the belt has turned increases, charge accumulation also increases, whereby the level of electricity to be removed also raises with time.

A measure for enhancing electricity removal performance of the belt electricity remover for removing the insulating belt for transporting transfer material can be taken, in which case a new problem occurs that as the electricity removal performance is enhanced, leakage becomes prone to occur; the above-mentioned problem cannot be solved.

(3) Problem associated with photosensitive body history change caused by seam part of transfer belt For example, image formation apparatuses shown in FIGS. 28 and 29 are known as those for forming images by transferring toner images formed on photosensitive drums directly or indirectly to an endless transfer belt.

FIG. 28 is a schematic diagram of a so-called tandem color image formation apparatus with four photosensitive drums 51 arranged in series along the turning passage of a transfer belt 50. The apparatus forms yellow Y, magenta M, cyan C, and black BK toner images on the photosensitive drums 51 in sequence at predetermined time intervals and transfers the toner images in order from the photosensitive drums 51 to a recording sheet 52 held and transported on the transport belt 50. That is, a multiple toner image with four color toner images overlapping each other is formed on the recording sheet 52 passing through a transfer part of the black photosensitive drum 51 placed most downstream and the recording sheet 52 is inserted into a fuser (not shown), whereby a color image is provided.

On the other hand, FIG. 29 is a schematic diagram to show a color image formation apparatus using a transfer belt 53 as an intermediate transfer body for color matching of color image. In the apparatus, a photosensitive drum 55 provided with yellow Y, magenta M, cyan C, and black BK developing units 54 is placed adjoining the transfer belt 53; each time the transfer belt 53 makes one turn, any one color toner image is formed on the photosensitive drum 55 and is transferred directly to the transfer belt 53 and these steps are repeated consecutively for each of four color toner images. Therefore, a multiple transferred toner image is completed on the transfer belt 53 with four turns of the transfer belt 53 and is transferred to a recording sheet 56 in batch, whereby a color image is provided.

In each of the two types of image formation apparatuses, the transfer belt is formed of a dielectric film about 50–150 μm thick; if charges having an opposite polarity to that of toner are injected into the rear face of the transfer belt with a corona discharger, etc., the toner image on the photosensitive drum is transferred to the transfer belt.

By the way, the endless transfer belts as described above can also be manufactured as seamless belts, but both ends of a belt having ends are joined by a technique of ultrasonic welding, etc., to form an endless transfer belt from viewpoints of costs and difficulty of formation. Therefore, a seam part exists in the endless transfer belt; paper powder and toner and discharge products produced by the corona discharger are prone to enter the seam part, and in an image formation apparatus that can make a double-sided copy, a releasing agent applied to a fixing roller is deposited on the transfer belt with a double-sided copy recording sheet as a medium and thus is also prone to enter the seam part.

Thus, the seam part of the transfer belt and other portions differ largely in resistance value because of the deposits. When the seam part passes through the transfer position of a toner image, a special potential history is formed only for the area on the photosensitive drum coming in contact with the seam part. If another toner image is formed in the area on the photosensitive drum coming in contact with the seam part, a toner image at a desired density is not provided in the area and a horizontal stripe corresponding to the seam part occurs in a formed record image.

Generally, for a photosensitive drum where toner image transfer is complete, an electrostatic latent image history in the preceding cycle is erased with an electricity removal corotron, an electricity removal lamp, etc., before the formation cycle of the next toner image, but a potential history corresponding to the transfer belt seam part cannot be erased by the function of the electricity removal corotron for removing a latent image history.

We have discussed the problems caused by the transfer belt seam part; if the transfer belt has a gripper for holding the tip of a recording sheet, the same problem also occurs for the gripper, because if the gripper exists on the transfer belt, paper powder, toner, etc., is also prone to be deposited on the surroundings of the gripper like the seam part.

(4) Problem caused by pressing transfer belt or releasing it

For example, as shown in Japanese Patent Laid-Open No. Hei 4-166957, a large number of color image formation apparatuses proposed in recent years each uses four drum-like photosensitive bodies each provided with electrophotographic image formation process means, places recording material support members shaped like endless belts so that they approach the transfer positions of the photosensitive drums and rotate, and disposes at transfer positions a plurality of press means for pressing a recording material transport belt against the photosensitive drums for bringing the belt into contact with the drum surfaces.

The color image formation apparatus turns on all of a plurality of press means as transfer auxiliary members just before transferring a toner image on the first color photosensitive drum (pressing operation) and turns off all the press means just after the completion of transfer of a toner image on the last color photosensitive drum (pressing releasing operation). It turns on and off the press means at such timings, thereby suppressing the time for the press means to push up the recording material transport belt to the necessary minimum for preventing the photosensitive drums, the recording material transport belt, and the press means from wearing, etc.

However, the color image formation apparatus involves a large problem that poor image quality is caused by a brake action, etc., caused by frictional resistance or vibration occurring when the press means are turned on/off for the recording material transport belt.

SUMMARY OF THE INVENTION

The invention is intended for solving the problems (1) to (4) in the prior art. It is an object of the invention to provide an image formation apparatus which has a cleaning member having both a function of efficiently capturing suspended substances deposited on the inner face of an endless belt member and a function of sufficiently holding the deposited suspended substances, and can prevent an image defect or a running failure of the endless belt member caused by deposition of suspended substances on the inner face of the endless belt member.

It is another object of the invention to provide an image formation apparatus which can prevent an apparatus malfunction caused by the electrostatic effect in a belt transporter for transporting a transfer material and a poor image.

It is still another object of the invention to provide an image formation apparatus which can exclude the effect of a transfer belt seam part and gripper on toner image formation on photosensitive drums and form high-grade, high-quality record images.

It is another object of the invention to provide a color image formation apparatus which can prevent poor picture quality caused by the on/off operation of press means.

According to a first aspect of the invention, there is provided an image formation apparatus for forming an image with an endless belt member wherein the endless belt member is provided on the inner face with an inner face cleaning member having both a function of capturing deposits deposited on the inner face of the endless belt member and a function of holding the captured deposits.

According to a second aspect of the invention, there is provided an image formation apparatus comprising a transfer material transport dielectric belt being placed on a plurality of rolls containing at least a drive roll and a stripping part roll for turning and electrostatically attracting a transfer material for transferring a toner image formed on an image support and transporting the transfer material to a transfer position and one or more image supports disposed in a belt placement area between the drive roll and the stripping part roll for the dielectric belt, wherein members coming in contact with a portion outside an image formation area in a width direction perpendicular to an advance direction of the transfer material transport dielectric belt are grounded.

The grounded members are not limited if there is no harm in grounding the members; for example, the grounded members are conductive guide members for elastically supporting side ends of the transfer material transport dielectric belt, the roll members on which the belt is placed, and a belt cleaning member.

The image supports are made of photosensitive or dielectric substances capable of latent image and toner image formation by the electrophotographic apparatus or an electrostatic recording apparatus and may be shaped like drums or belts. They are disposed within the belt placement area between the drive roll and the stripping part roll for the transfer material transport dielectric belt.

According to a third aspect of the invention, there is provided, in an image formation apparatus comprising one or more photosensitive bodies for forming toner images responsive to image information and an endless transfer belt placed adjoining the photosensitive bodies for directly or indirectly transferring the toner images from the photosensitive bodies to the transfer belt, the improvement which comprises means for detecting timing at which an area having a different electrostatic characteristic existing on the transfer belt passes through a toner image transfer position and potential unevenness correction means for correcting a surface potential on a peripheral surface of the photosensitive body opposed to the area having a different electrostatic characteristic existing on the transfer belt at the transfer position based on a detection signal of the timing detection means.

In the technical means, the area having a different electrostatic characteristic existing on the transfer belt means such an area remarkably affecting a potential history of the photosensitive body when the area comes in contact with the photosensitive body; specifically, it is the seam part of the endless transfer belt or the recording sheet gripper provided on the transfer belt.

As the potential unevenness correction means, an electricity removal corotron or an electricity removal lamp operating based only on a detection signal of the timing detection means may be disposed in the surroundings of the photosensitive body aside from the electricity removal corotron or electricity removal lamp for removing a latent image history on the photosensitive body. However, from the viewpoint of space saving, preferably the electricity removal corotron for removing a latent image history is also used as the potential unevenness correction means of the invention and output of the electricity removal corotron is switched based on a detection signal of the timing detection means.

By the way, to arrange a plurality of photosensitive bodies along the transfer belt for transferring toner images from the photosensitive bodies, it turns out that as the photosensitive bodies are positioned more downstream in the turn direction of the transfer belt, a larger potential history tends to be formed when the photosensitive body comes in contact with the area having a different electrostatic characteristic existing on the transfer belt. Therefore, to embody the invention, if a plurality of photosensitive bodies are arranged along the transfer belt, preferably, of the potential unevenness correction means disposed for the photosensitive bodies, output of the potential unevenness correction means positioned downstream in the turn direction of the transfer belt is set so as to become larger than that of the potential unevenness correction means positioned upstream.

According to a fourth aspect of the invention, there is provided a color image formation apparatus comprising a plurality of image supports each for forming a single-color toner image, a transfer material transport body being placed near over transfer positions of the image supports, and a plurality of press means for pressing the transfer material transport body against the image support sides at the transfer positions for bringing the transfer material transport body into contact with the image supports, wherein press operation of the press means is executed in sequence before a first-color latent image write step is started and wherein the press operation of the press means is released after a last-color transfer step is completed.

The press means are provided in a one-to-one correspondence with the image supports; for example, each press means can be made up of a press member for abutting the transfer material transport body and an attachment and detachment mechanism capable of moving up and down the press member for energizing the transfer material transport body toward the image support and releasing the energizing.

The press operation of a plurality of the press means may be performed in sequence at intervals over time and the press operation of the press means for the last color needs always be ended before the first-color latent image write step is started. Moreover, the press operation of a plurality of the press means is released after the transfer step on the last-color image support is complete. The releasing operation may be performed at the same time or in sequence for all the press means; preferably it is performed at intervals over time. To perform and release the press operation of the press means in sequence, in any case, it is performed in order starting at the press means for the first color and ending with the press means for the last color.

Therefore, the timings of the press operation of a plurality of the press means and the releasing operation may be set so that at least the press operation or the release operation is not performed while latent image write is started or a transfer step is not ended on any image support.

In the invention, the image supports are made of photosensitive or dielectric substances capable of latent image formation by the electrophotographic apparatus or an electrostatic recording apparatus and may be shaped like drums or belts. The transfer material transport body is provided to attract and hold a transfer material made up of recording paper, etc., for transferring single-color toner images formed on the image supports and transporting it to transfer positions, etc.,; it is shaped like an endless belt or a drum. For the belt-like transfer material transport body, preferably a seamless belt is used.

The image formation apparatus of the invention, which comprises a plurality of image supports independent of each other, can form not only full color images, but also monochrome images and monocolor images. It can be applied mainly to color copiers, color printers, etc.

In the first aspect of the invention, the endless belt member is provided on the inner face with a cleaning member having both a function of capturing deposits deposited on the inner face of the endless belt member and a function of holding the captured deposits. Thus, if substances of toner, paper powder, etc., suspended in the color image formation apparatus are deposited on the inner face of the endless belt member, they can be reliably removed by the cleaning member having the function of capturing the deposits and the captured deposits can be held by the cleaning member also having the function of holding the captured deposits. Therefore, the deposits once captured by the cleaning member are not again deposited on the inner face of the endless belt member; an image defect or a running failure of the endless belt member caused by deposition of the suspended substances on the inner face of the endless belt member can be prevented.

In the second aspect of the invention, the transfer material transport dielectric belt, which transports a transfer material by electrostatic attraction thereof and executes electrostatic transfer and comes in contact with parts related to the belt, is often placed in a charged state. Although the image formation area of the belt is electricity-removed by the belt electricity removal means, other belt areas (both side end portions) are not electricity-removed and charges easily accumulate because of friction with the rolls and other contact parts. Then, such members coming in contact with the dielectric belt are grounded for preventing charges from accumulating, etc.

They are grounded before main electricity removal of the belt electricity removal means (however, downstream from the transfer position of the nearest image support to the stripping part roll) or in addition, are also grounded after the main electricity removal (however, before the transfer material attraction position). Charges accumulated because the dielectric belt is also charged more than expected by strip discharge occurring in the stripping part of the transfer material can also be reduced or removed efficiently by the belt electricity removal executed before the main electricity removal step.

In the third aspect of the invention, even if an area having a different electrostatic characteristic existing on the transfer belt passes through the transfer position of a toner image and a special potential history occurs in the photosensitive body area coming in contact with the area, the potential unevenness correction means is operated based on a detection signal of the timing detection means, thereby removing the potential history on the photosensitive body caused when the photosensitive body came in contact with the area. Therefore, such a potential history can be prevented from affecting toner image formation in the next toner image formation cycle.

In the fourth aspect of the invention, since the press operation of a plurality of the press means or the releasing operation is not performed while latent image write is started or a transfer step is not ended on any image support, vibration, etc., caused by the operation does not adversely affect image formation on the image support or transfer of the image. Moreover, since the press operation of the press means is performed in sequence at intervals over time, brake action between the image support and the transfer material transport body, instantaneous bending of the transport body, or the like caused by the press operation does not adversely affect the image formation or transfer of the image either. Particularly, if the press operation of a plurality of the press means is performed at the same time, there is a possibility that drive power will concentrate and be excessively consumed because of the operation, inducing an operation failure of the entire apparatus due to voltage drop, etc.,; however, such a worry is not involved in the invention.

DETAILED DESCRIPTION OF THE PREFERRED EMBODIMENTS

Referring now to the accompanying drawings, there are shown preferred embodiments of the invention.

(First Embodiment)

Figure 2:
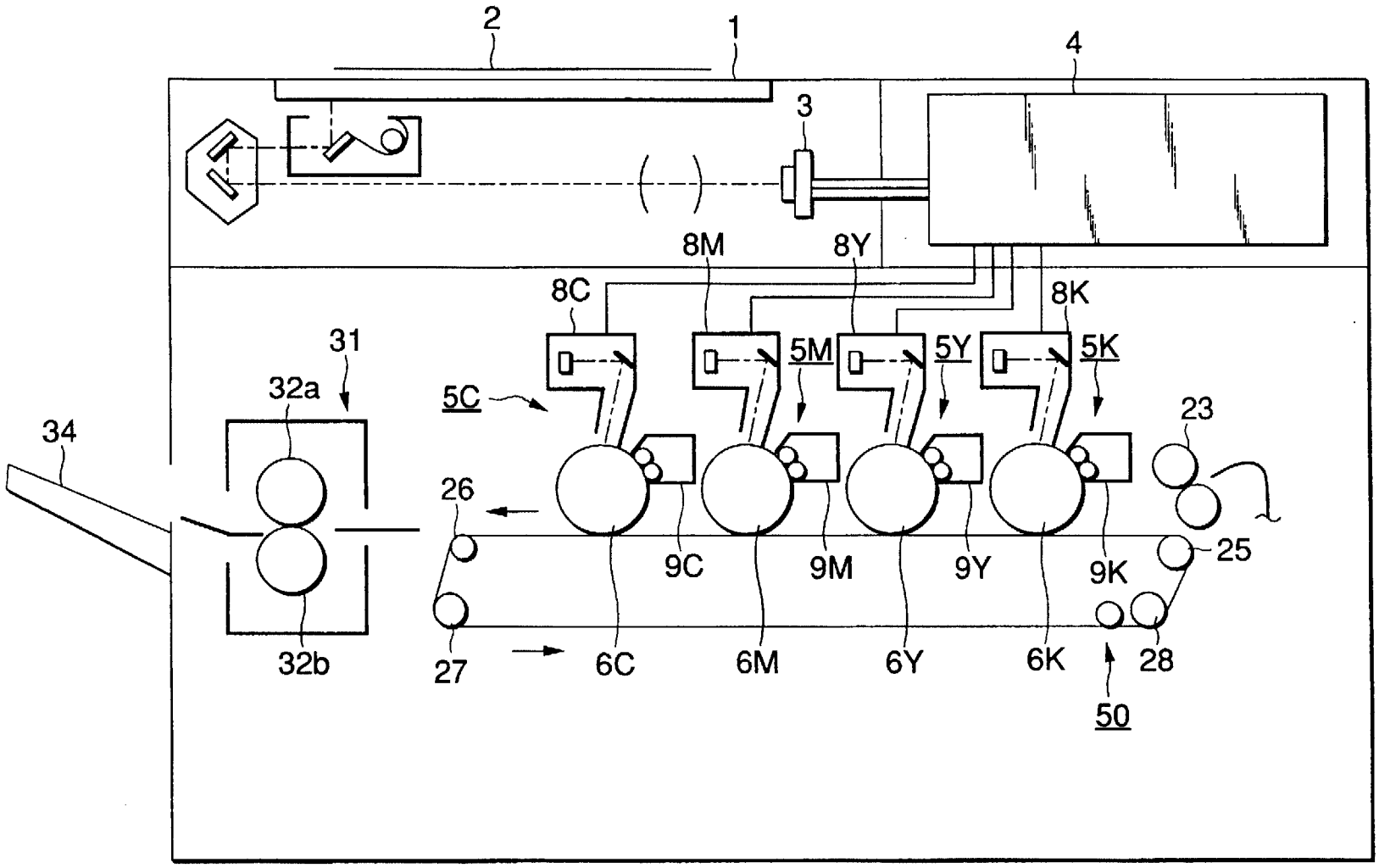
FIG. 2 is a general block diagram to show a digital color copier as the first embodiment of the image formation apparatus according to the invention.

FIG. 2 is a general block diagram to show a digital color copier as a first embodiment of an image formation apparatus according to the invention.

In FIG. 2, a document 2 placed on platen glass 1 is read as RGB analog image signals by an image scanner comprising a color CCD sensor 3 via a scan optical apparatus consisting of a light source, a scan mirror, etc. The RGB analog image signals read by the color CCD sensor 3 are converted into KYMC image signals by an image processing section 4 and the KYMC image signals are temporarily stored in a memory contained in the image processing section 4.

Figure 3:
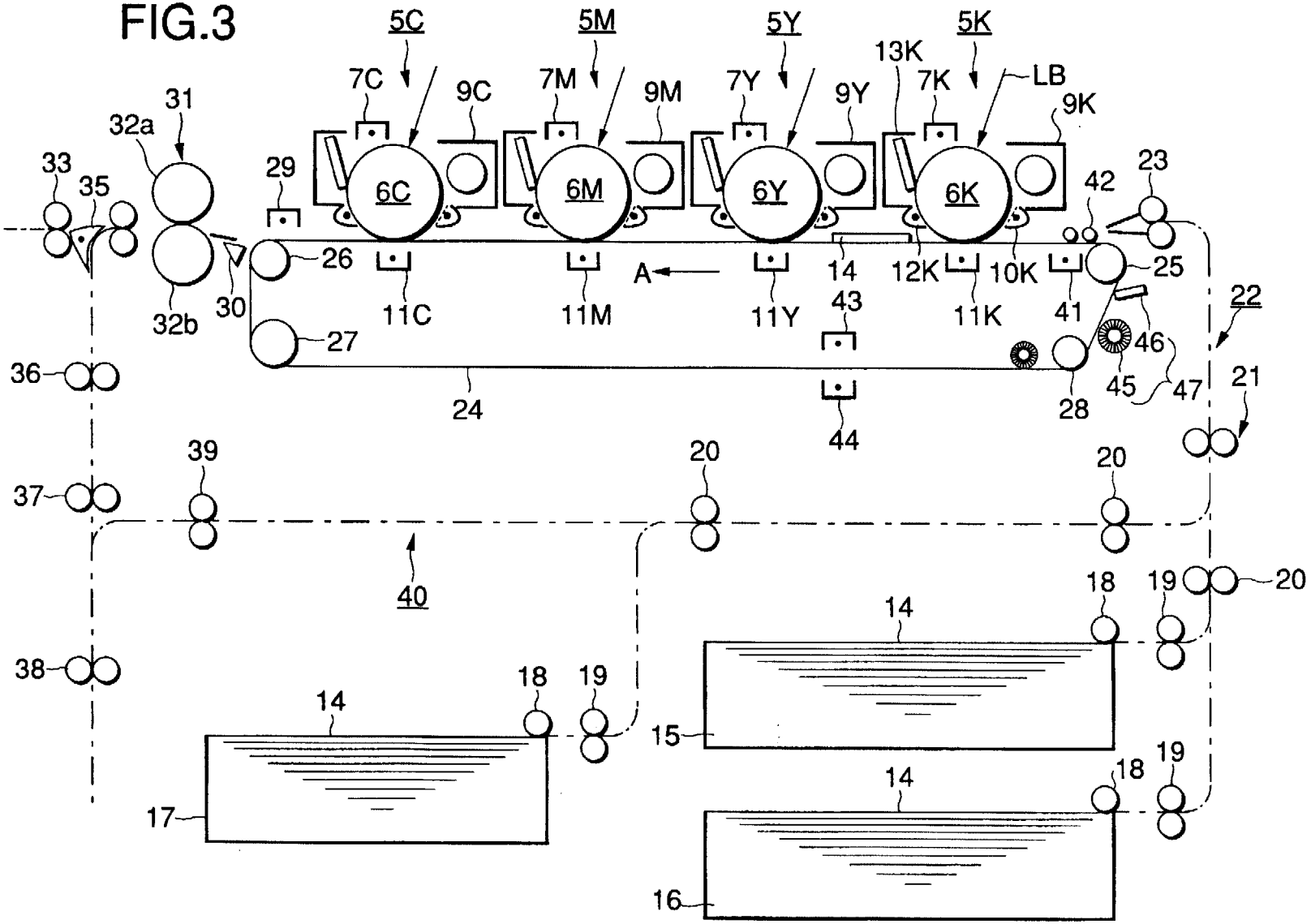
FIG. 3 is a block diagram to show an image formation section of the digital color copier as the first embodiment of the image formation apparatus according to the invention.

As shown in FIGS. 2 and 3, the image processing section 4 outputs black (K), yellow (Y), magenta (M), and cyan (C) color image data in sequence to laser beam scanners 8K, 8Y, BM, and 8C of black (K), yellow (Y), magenta (M), and cyan (C) color image formation units 5K, 5Y, 5M, and 5C, and the surfaces of photosensitive drums 6K, 6Y, 6M, and 6C are scanned by and exposed to laser beams LBs output by the laser beam scanners 8K, 8Y, 8M, and 8C in response to the image data for forming electrostatic latent images. These electrostatic latent images formed on the photosensitive drums 6K, 6Y, 6M, and 6C are developed as black (K), yellow (Y), magenta (M), and cyan (C) color toner images respectively by developing units 9K, 9Y, 9M, and 9C.

Transfer paper 14 of a predetermined size to which the color toner images formed on the photosensitive drums 6K, 6Y, 6M, and 6C are to be transferred is transported from any of paper feed cassettes 15, 16, and 17 via a paper transport passage 22 made up of a paper feed roller 18 and paper transport roller pairs 19, 20, and 21, as shown in FIG. 3. The transfer paper 14 supplied from any of the paper feed cassettes 15–17 is sent onto a transfer belt 24 by a resist roller 23 rotated at a predetermined timing. The transfer belt 24 is placed on a drive roller 25, a stripping roller 26, a tension roller 27, and an idle roller 28 endlessly under a given tension, and is circulated at a predetermined speed in the arrow direction by the drive roller 25 rotated by a dedicated motor (not shown) having an excellent constant speed property. Used as the transfer belt 24 is, for example, a belt shaped like an endless belt by forming a synthetic resin film of PET, etc., having flexibility like a band and connecting both ends of the synthetic resin film formed like a band by means of welding, etc.

The paper feed timing and image write timing are determined so that the tip of the transfer paper 14 transferred on the transfer belt 24 and the tip of the image formed on the first photosensitive drum 6K by the first image formation unit 5K match in the lowest transfer point of the photosensitive drum 6K. The visible image on the photosensitive drum 6K is transferred by a transfer corotron 11K to the transfer paper 14 arriving at the transfer point, and further the transfer paper 14 arrives at a transfer point just below the photosensitive drum 6Y. Likewise, the visible image on the photosensitive drum 6Y is transferred to the transfer paper 14 arriving at the transfer point just below the photosensitive drum 6Y. When the visible images on other photosensitive drums have been transferred to the transfer paper 14 in a similar manner, the transfer paper 14 is furthermore transported on the transfer belt 24. When the transfer paper 14 reaches the proximity of the stripping roller 26, it undergoes electricity removal by a electricity removal corotron 29 for stripping and is stripped from the transfer belt 24 by the stripping roller 26 whose curvature radius is set small and a stripping claw 30. Then, the transfer paper 14 to which the four color toner images have been transferred is fixed by a fuser 31 with a heating roller 32*a* and a pressurizing roller 32*b* and is discharged onto a discharge tray shown in FIG. 2 by a discharge roller pair 33, and a color image is copied.

To copy a full color image to both sides of the transfer paper 14, as shown in FIG. 3, without discharging the transfer paper 14 formed with a color image on one side by the discharge roller pair 33, the transport direction of the transfer paper 14 is changed downward by a change plate 35 and the transfer paper 14 turned out is transported via a paper transport passage 40 made up of paper transport roller pairs 36, 37, 38, 39, etc., to the transfer belt 24 again through the paper transport passage 22, then a color image is formed on the rear face of the transfer paper 14 in a similar process as described above.

As shown in FIG. 3, the black, yellow, magenta, and cyan color image formation units 5K, 5Y, 5M, and 5C are the same in configuration and form black, yellow, magenta, and cyan toner images respectively in sequence, as described above. The color image formation units 5K, 5Y, 5M, and 5C comprise photosensitive drums 6K, 6Y, 6M, and 6C. The surfaces of the photosensitive drums 6K, 6Y, 6M, and 6C are uniformly charged by scorotrons 7K, 7Y, 7M, and 7C for primary charge, then are scanned by and exposed to laser beams LBs for image formation output from the laser beam scanners 8K, 8Y, 8M, and 8C in response to image data for forming electrostatic latent images corresponding to the colors. The electrostatic latent images formed on the surfaces of the photosensitive drums 6K, 6Y, 6M, and 6C are developed with black toner, yellow toner, magenta toner, and cyan toner by the developing units 9K, 9Y, 9M, and 9C of the color image formation units 5K, 5Y, 5M, and 5C to form visible toner images, which then are before-transfer charged by before-transfer chargers 10K, 10Y, 10M, and 10C, then charged by transfer chargers 11K, 11Y, 11M, and 11C for transfer to the transfer paper 14 held on the transfer belt 24 in sequence. The transfer paper 14 to which the black, yellow, magenta, and cyan toner images have been transferred is detached from the transfer belt 24, then is fixed by the fuser 31 for forming a color image, as described above.

Further, the transfer paper 14 is supplied from any of the paper feed cassettes 15–17 and is transported on the transfer belt 24 at a predetermined timing by the resist roller 23. It is also held and transported on the transfer belt 24 by a paper holding charger 41 and a charge roller 42.

After the completion of the toner image transfer step, the photosensitive drums 6K, 6Y, 6M, and 6C undergo electricity removal by before-cleaning electricity removers 12K, 12Y, 12M, and 12C, and remaining toner, etc., on the drums is removed by cleaners 13K, 13Y, 13M, and 13C for the next image formation process.

After the transfer paper 14 is stripped off, the transfer belt 24 undergoes electricity removal by transfer belt electricity removal corotron pairs 43 and 44 in the circulating track, and toner, paper powder, and the like on the surface of the transfer belt 24 are removed by a cleaning unit 47 consisting of a rotating brush 45 and a blade 46.

By the way, in the embodiment, the transfer belt is provided on the inner face with a cleaning member having a function capturing deposits deposited on the inner face of the transfer belt and a function holding the deposits. For example, a member with fine fibers densely transplanted in set-up relation is used as the cleaning member.

Since the digital color copier holds the transfer paper 14 by charging the transfer belt 24 by the paper holding charger 41 from the rear face of the transfer belt 24 and transfers toner images by charging the transfer belt 24 by the transfer chargers 11K, 11Y, 11M, and 11C from the rear face of the transfer belt 24, as shown in FIG. 3, the transfer belt 24 made of a dielectric substance of an insulating synthetic resin film of PET, etc., remains charged almost all the while until electricity of the transfer belt 24 is removed by the electricity removal corotron pairs 43 and 44. Thus, substances such as black toner, yellow toner, magenta toner, cyan toner, paper powder of the transfer paper 14, dust, and hairs suspended in the digital color copier are electrostatically attracted to the surface and rear face of the transfer belt 24. Particularly, if suspended substances such as toner and paper powder remain deposited on the rear face of the transfer belt 24, uneven transfer is caused when toner images formed on the photosensitive drums 6K, 6Y, 6M, and 6C are transferred onto the transfer paper 14, or in passage through rollers 25, 26, 27, and 28 for circulating the transfer belt 24, the suspended substances are made to intervene between the transfer belt 24 and the rollers 25, 26, 27, and 28 or are deposited on the surfaces of rollers 25, 26, 27, and 28, delicately changing the outer diameters of the rollers 25, 26, 27, and 28, thus causing the transfer belt 24 to run on one side along the axial direction (the phenomenon is called a walk phenomenon) and color image registration to shift, impairing the image quality or bringing the edge of the transfer belt 24 into contact with any other member, thereby inviting damage.

Then, in the embodiment, a cleaning member 50 for cleaning suspended substances such as toner and paper powder deposited on the inner face of the transfer belt 24 is placed on the inner face of the transfer belt 24 and near upstream of the idle roller 28, as shown in FIG. 3.

Figure 4:
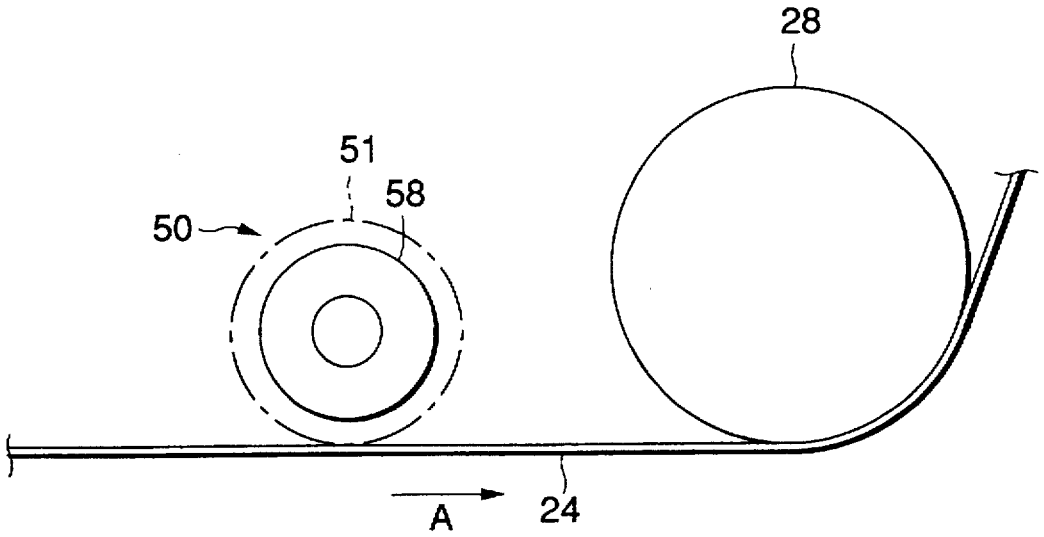
FIG. 4 is a block diagram to show the vicinity of the cleaning member of the digital color copier.

FIG. 4 is a schematic enlarged view to show the cleaning member according to the embodiment.

In the figure, the cleaning member 50 is placed near upstream of the idle roller 28 so as to come in contact with the inner face of the transfer belt 24 whose electricity has been removed by the electricity removal corotron pairs 43 and 44 under a predetermined contact pressure; it comes in contact with the inner face of the transfer belt 24 in a fixed state without rotation. The transfer belt 24 moves along the arrow A direction at a speed equal to the process speed of the digital color copier. The cleaning member 50 is pressed against the transfer belt 24 so as to have a reasonable penetration amount with respect to the transfer belt 24. The penetration amount is set considering the length, thickness, density, etc., of the brush of the cleaning member 50; for example, if the brush of the cleaning member 50 is long and thin, the cleaning member 50 may be brought into contact with the transfer belt 24 in a relatively large penetration amount, namely, under a high contact pressure or if the brush of the cleaning member 50 is short and thick, the cleaning member 50 may be brought into contact with the transfer belt 24 in a relatively small penetration amount, namely, under a low contact pressure.

As shown in FIGS. 1 and 5–7, to form the cleaning member 50, a base cloth 52 with extremely fine fibers 51 densely transplanted in set-up relation is bonded to the outer peripheral surface of a synthetic resin cylinder 53 in a state in which it is wound spirally thereon, whereby the extremely fine fibers 51 are densely transplanted in a state in which they are set up outward in the radial direction of the cylindrical cleaning member 50. Further, Nos.45–55, for example, No.48 pair-twisted extremely fine acrylic fibers are used as the fibers 51 of the cleaning member 51, but fibers of any other thickness may be used, needless to say.

Figure 8:
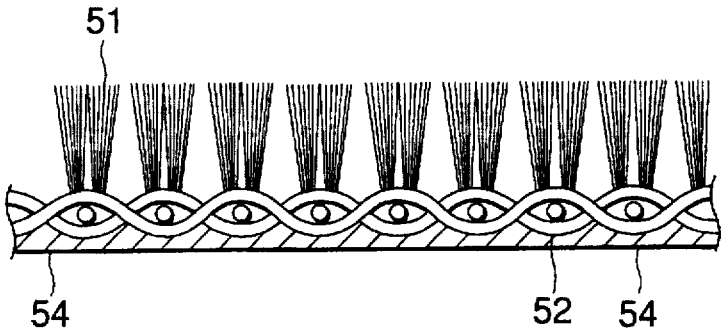
FIG. 8 is a sectional view to show a base cloth of the cleaning member with fibers transplanted.
Figure 9:
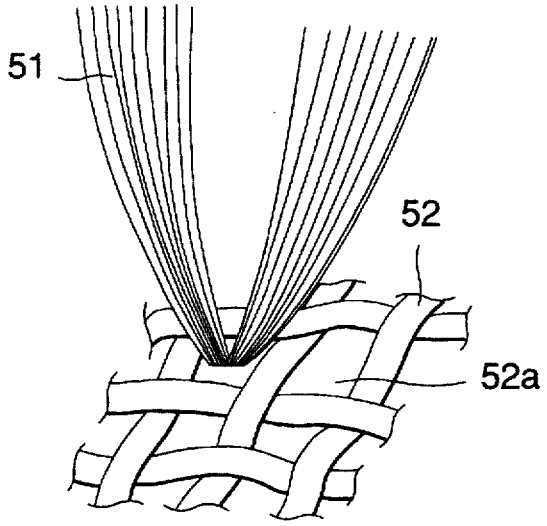
FIG. 9 is a perspective view to show the base cloth of the cleaning member with fibers transplanted.
Figure 10:
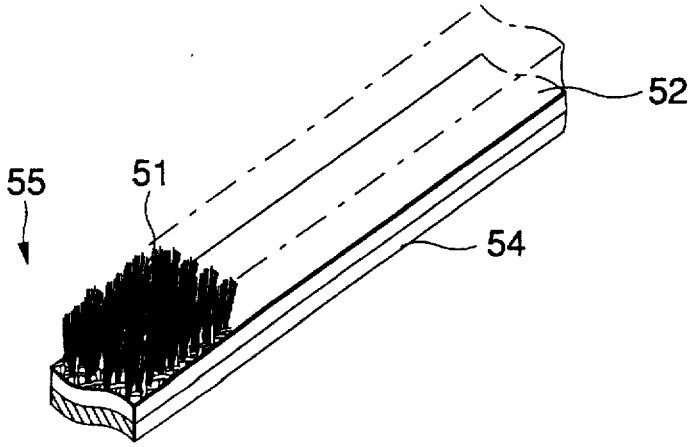
FIG. 10 is a perspective view to show a state in which the base cloth of the cleaning member with fibers transplanted is cut to a band.

As shown in FIGS. 8 and 9, the fibers 51 of the cleaning member 50 are woven in meshes **52*a* of the base cloth 52 in a state in which a large number of fibers are bundled. For example, a cloth with No.30 pair-twisted rayon fibers woven in the vertical direction and No.10 single-twisted rayon fibers woven in the horizontal direction is used as the base cloth 52, but other fibers may be used, needless to say. The base cloth 52 has 30 to 45, for example, 42 bundles of acrylic fibers 51 woven in the vertical direction and 30 to 45, for example, 40 bundles of acrylic fibers 51 woven in the horizontal direction densely in the meshes 52*a*, forming a so-called moquette pile weave. The density of the acrylic fibers 51 bundled may be set to any other value than the above, needless to say. As shown in FIG. 8, an adhesive 54 made of acrylic family resin is applied to the full face of the rear face of the base cloth 52 with a large number of bundled acrylic fibers 51 transplanted for a ravel prevention process, and the resultant base cloth is cut to an elongated band 55, as shown in FIG. 10**.

Figure 11:
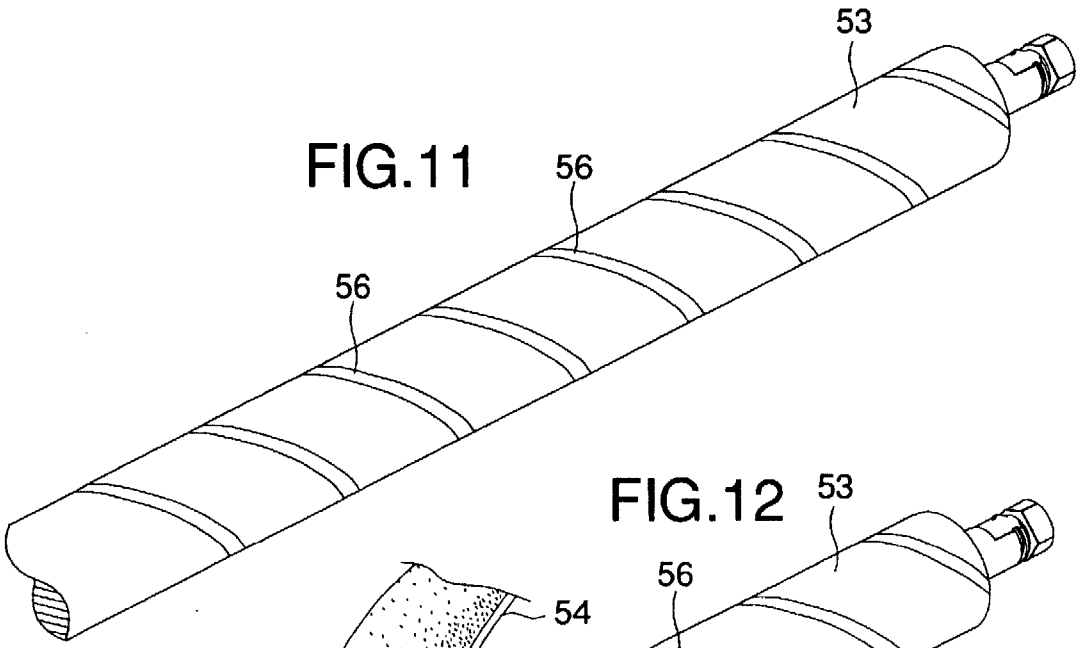
FIG. 11 is a perspective view to show a cylindrical member of the cleaning member.
Figure 12:
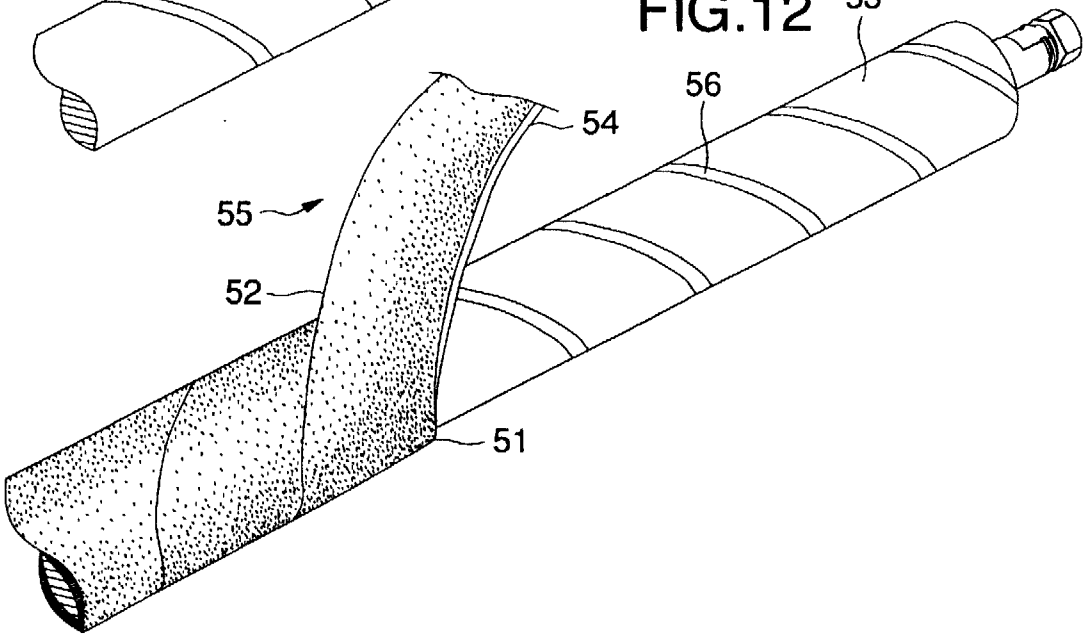
FIG. 12 is a perspective view to show a state in which the band-like base cloth with fibers transplanted is bonded to the cylindrical member of the cleaning member.

Next, an adhesive 56 is applied spirally to the outer peripheral surface of the cylindrical member 53 of the cleaning member 50, as shown in FIG. 11; of course, it may be applied fully to the outer peripheral surface of the cylindrical member 53. As shown in FIG. 12, the base cloth 52 having the acrylic fibers 51 transplanted and cut to the elongated band 55 is bonded to the outer peripheral surface of the cylindrical member 53 made of synthetic resin to which the adhesive 56 is applied in a state in which it is wound over the full length along the—direction of the cylindrical member 53 made of synthetic resin spirally at a predetermined tilt angle so as to become an opposite direction to the adhesive 56 previously applied to the outer peripheral surface of the cylindrical member 53 made of synthetic resin.

Figure 1:
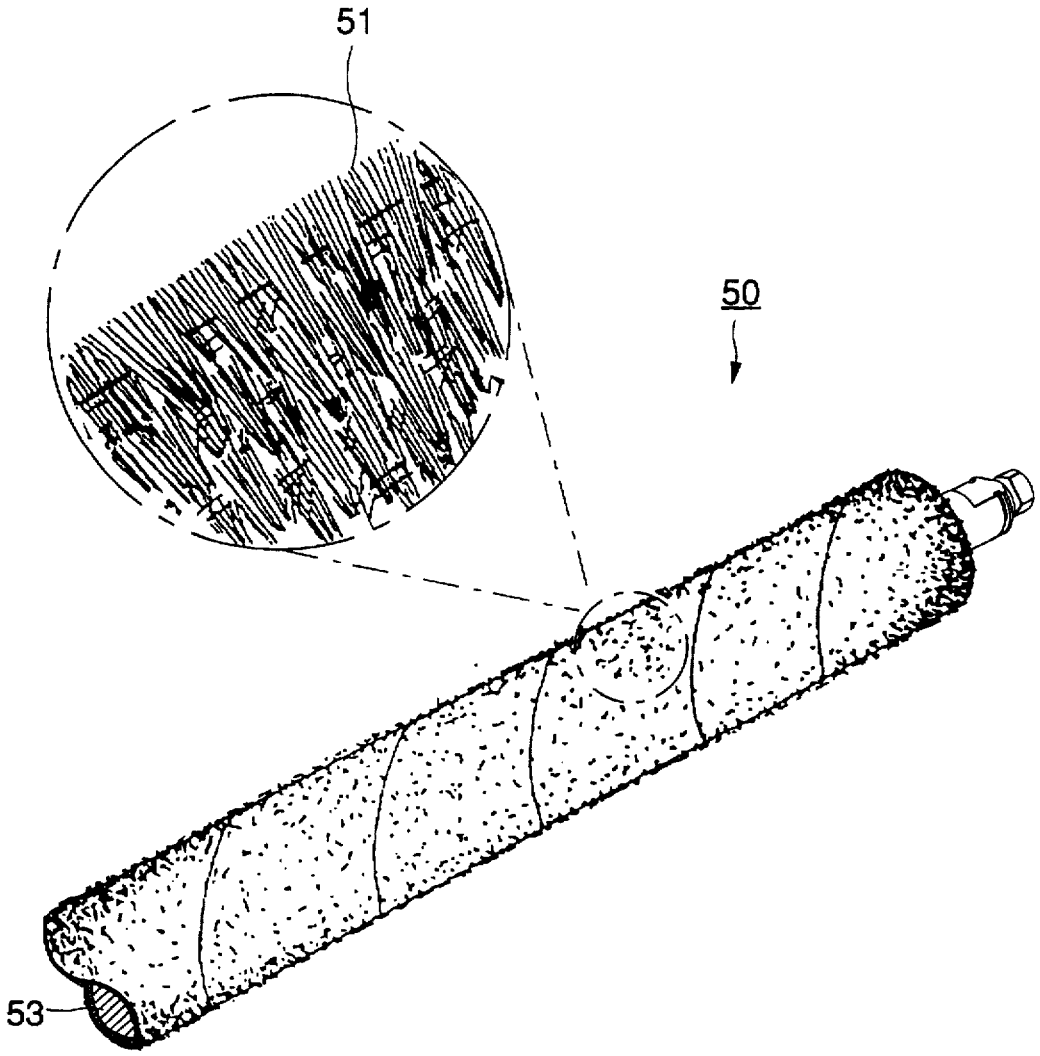
FIG. 1 is a perspective view of an inner face cleaning member to show a first embodiment of an image formation apparatus according to the invention.
Figure 7:
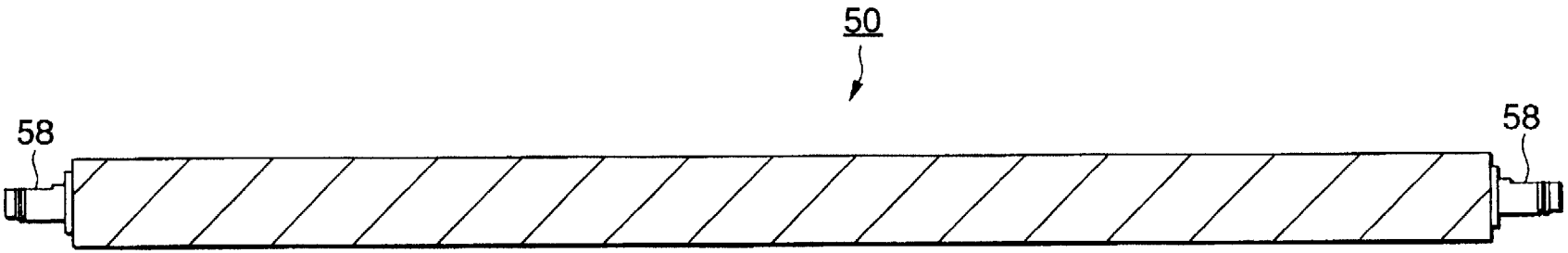
FIG. 7 is a front view to show the cleaning member.

Thus, the cleaning member 50 having the extremely fine acrylic fibers 51 densely transplanted in set-up relation is manufactured, as shown in FIGS. 1 and 7.

Figure 5:
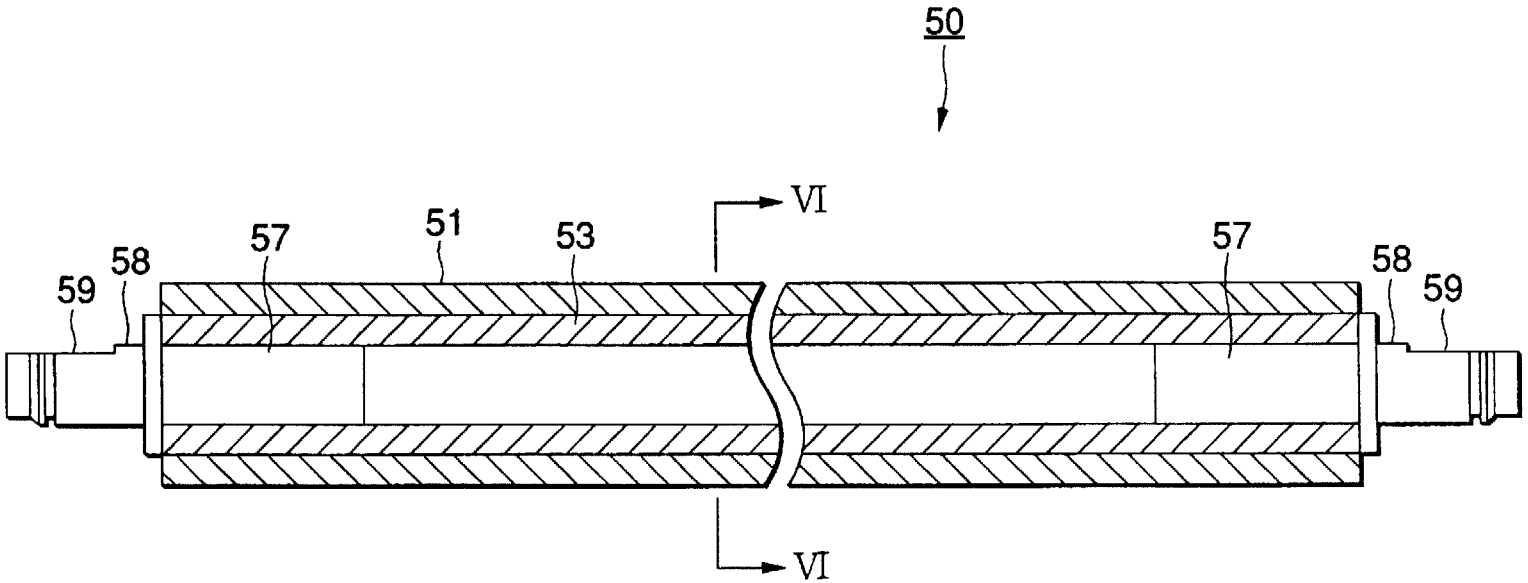
FIG. 5 is a transverse sectional view to show the cleaning member.
Figure 6:
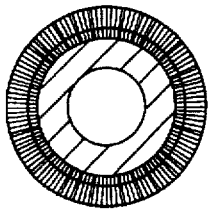
FIG. 6 is a longitudinal sectional view to show the cleaning member.
Figure 13:
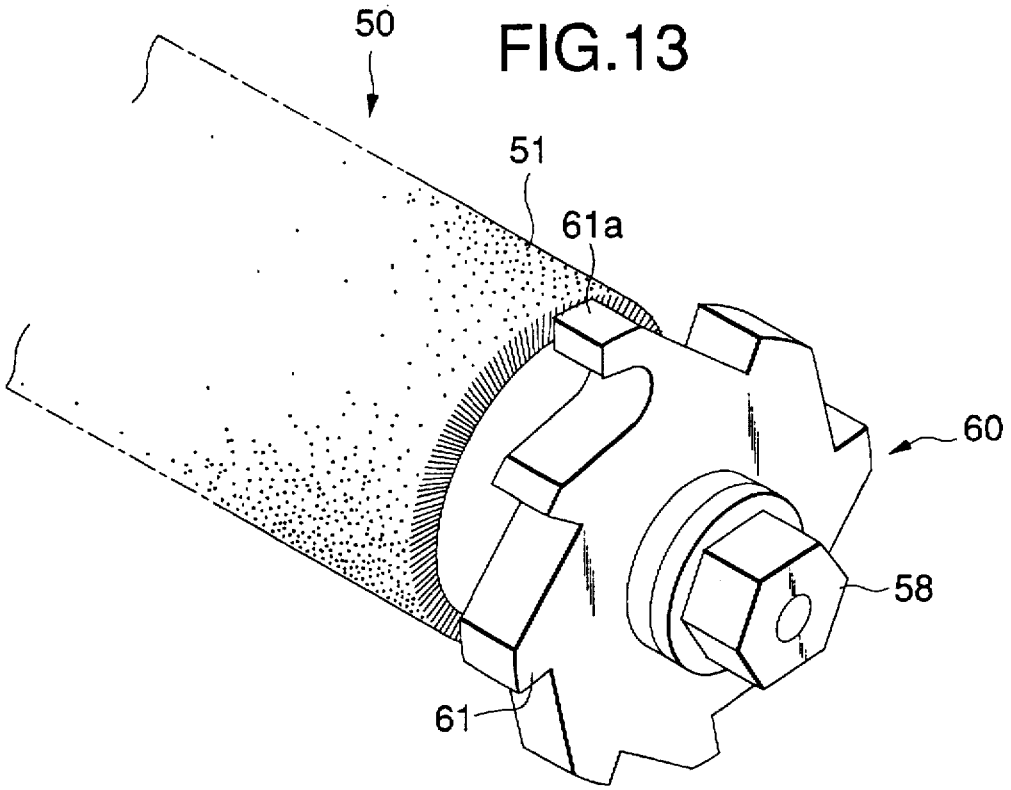
FIG. 13 is a perspective view to show one end of the cleaning member.
Figure 14:
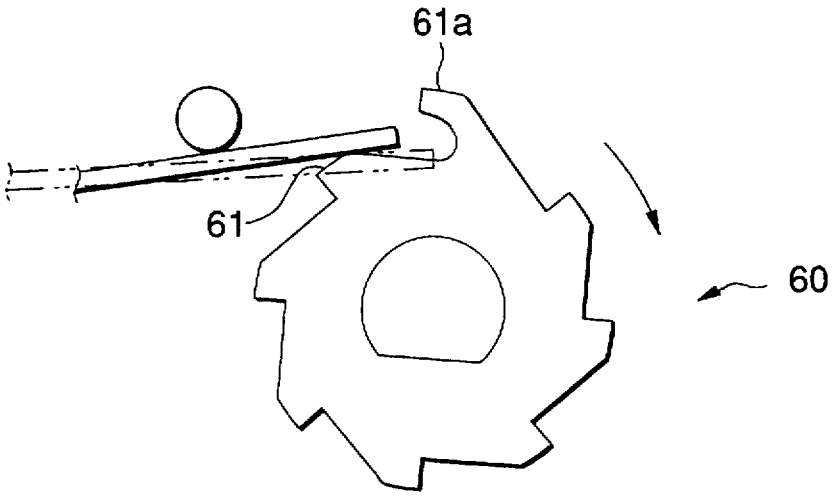
FIG. 14 is a front view to show a ratchet member of the cleaning member.
Figure 15:
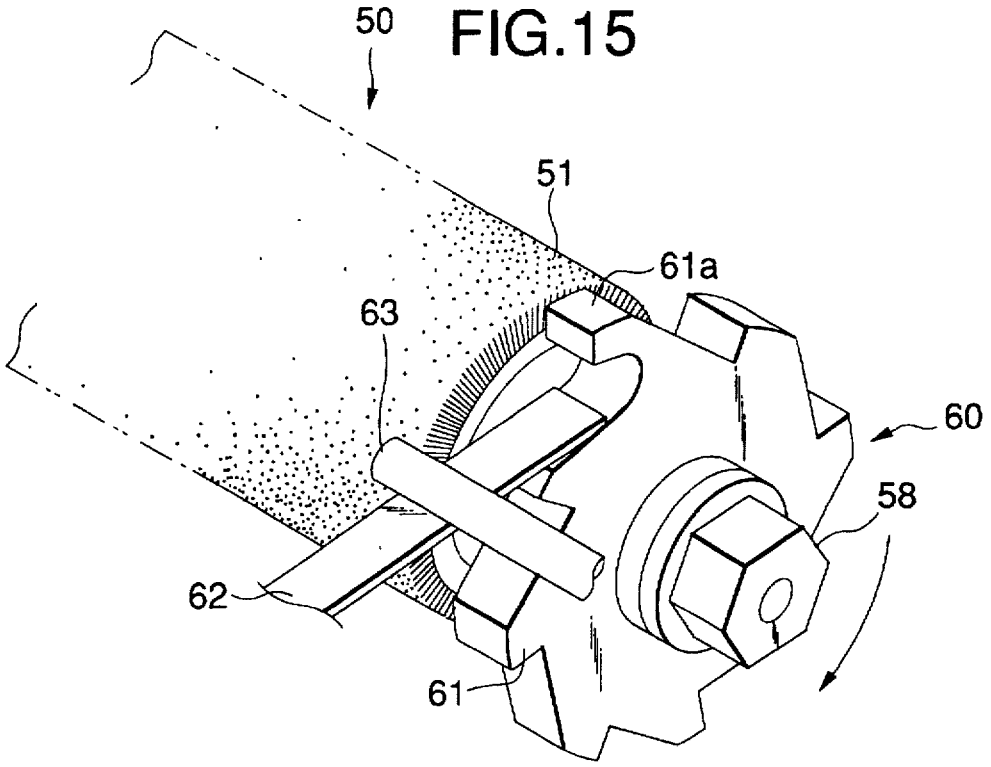
FIG. 15 is a perspective view of the main part to show a state in which the cleaning member is attached to the color copier.

Shaft-like members 57 made of synthetic resin are attached to both ends of the cylindrical member 53 made of synthetic resin for placing the cleaning member 50 in a state in which it comes in contact with the transfer belt 24 and rotating the cleaning member 50 by a predetermined amount as required so that a different surface of the cleaning member 50 comes in contact with the transfer belt 24. As shown in FIG. 5, the shaft-like members 57 are attached in a state in which they are fitted into both ends of the cylindrical member 53 made of synthetic resin, and stems 58 are projected outward at both ends of the cleaning member 50. At least one stem 58 at the shaft-like members 57 is formed with a D-cut face 59, and a ratchet member 60 for rotating the cleaning member 50 by a predetermined amount as required is attached to the stem 58 formed with the D-cut face 59 in a rotation stop state, as shown in FIG. 13. The ratchet member 60 is formed with eight claws 61 and only one claw 61*a* is formed longer than other claws 61, as shown in FIG. 14.

Further, the ratchet member 60 attached to the end of the cleaning member 50 is provided with a plate spring 62 abutting the claw 61, as shown in FIG. 13, with the cleaning member 50 mounted on a predetermined position of the color copier. When the predetermined number of copies is reached, the ratchet member 60 is turned by the service engineer or a drive mechanism (not shown) clockwise, whereby one claw 61 passes through the plate spring 62 because of elastic deformation of the plate spring 62 and the next claw 61 turns by 360 degrees/8 to the position abutting the plate spring 62. The cleaning member 50 is turned in sequence via the ratchet member 60 and different faces of the cleaning member 50 are used in sequence. Then, when the long claw 61*a* of the ratchet member 60 moves to the plate spring 62, the move of the plate spring 62 is regulated by a stopper 63, inhibiting the long claw 61*a* from climbing over and passing through the plate spring 62, as shown in FIG. 13; when all of eight divisions of the outer peripheral surface of the cleaning member 50 have once been used, the cleaning member 50 cannot be turned for further use. Turning the cleaning member 50 is prevented by the ratchet member 60 and the plate spring 62 for using the cleaning member 50 in fixed relation with the cleaning member 50 mounted on a predetermined position of the digital color copier.

If a predetermined number of copies are made and the face of the cleaning member 50 coming in contact with the transfer belt 24 becomes dirty, the cleaning member 50 is turned by the service engineer who performs maintenance inspection of the digital color copier or by the drive mechanism (not shown) clockwise, namely, in an opposite direction to the move direction of the transfer belt 24 in FIG. 4, whereby a new face of the cleaning member 50 adjoining the dirty face comes in contact with the transfer belt 24.

All parts of the cleaning members, such as the acrylic fibers 51, the synthetic resin cylindrical member 53, the shaft-like member 57, and the ratchet member 60, are formed of insulating material; therefore the, fibers 51, etc., of the cleaning member 50 are in an electric float state for the frame of the digital color copier.

In the composition, the digital color copier and from the transfer material support member according to the embodiment has the cleaning member having both the function of efficiently capturing suspended substances deposited on the inner face of the transfer belt and the function of sufficiently holding the deposited suspended substances, and can prevent an image defect or a running failure of the endless belt member caused by deposition of suspended substances on the inner face of the endless belt member, as described below:

While transporting transfer paper 14 on the transfer belt 24 with the transfer paper 14 held on the surface of the transfer belt 24 by charging the transfer belt 24 by the paper holding charger 41 from the rear face of the transfer belt 24, the digital color copier transfers toner images formed by the black, yellow, magenta, and cyan color image formation units 5K, 5Y, 5M, and 5C onto the transfer paper 14 in sequence, thereby making a color image copy. At the time, the transfer belt 24 is charged by the transfer chargers 11K, 11Y, 11M, and 11C from the rear face of the transfer belt 24 when the visible toner images formed by the color image formation units 5K, 5Y, 5M, and 5C are transferred onto the transfer paper 14.

Thus, the transfer belt 24 made of a dielectric substance of an insulating synthetic resin film of PET, etc., remains charged almost all the while until electricity of the transfer belt 24 is removed by the electricity removal corotron pairs 43 and 44. Therefore, substances such as black toner, yellow toner, magenta toner, cyan toner, paper powder of the transfer paper 14, dust, and hairs suspended in the digital color copier are electrostatically attracted to the surface and rear face of the transfer belt 24.

Figure 18:
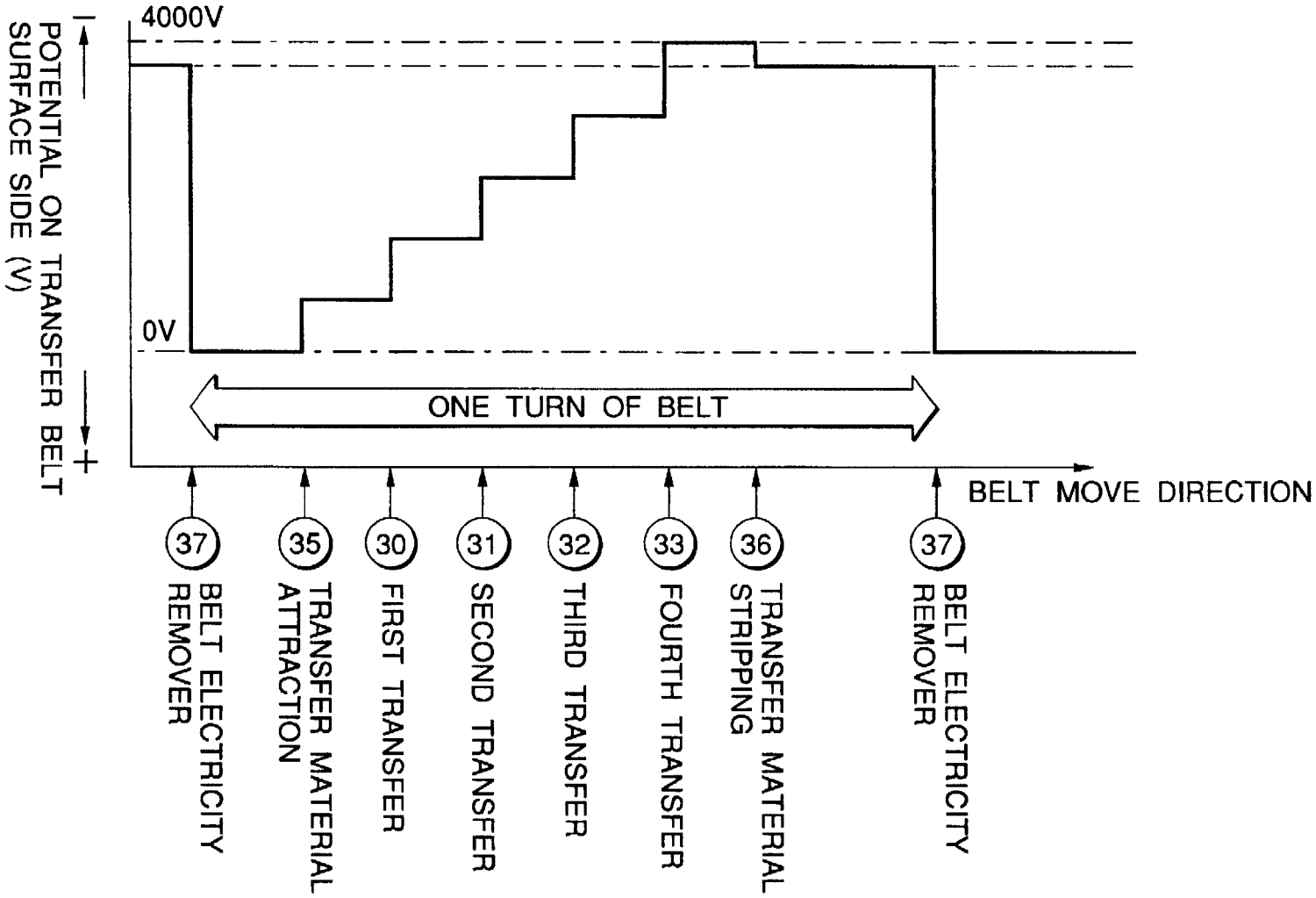
FIG. 18 is a timing chart to show a charge state of a transfer belt.

Then, in the embodiment, as shown in FIG. 18, when the transfer belt 24 completes formation of a color image and is subjected to electricity removal by the electricity removal corotron pairs 43 and 44 and then moves near the idle roller 28, as shown in FIGS. 3 and 4, the inner face of the transfer belt 24 is cleaned by the cleaning member 50 placed near upstream of the idle roller 28 for removing suspended substances 70 of toner, paper powder, etc., deposited on the inner face of the transfer belt 24. The reason why the inner face cleaning member 50 is placed near upstream of the idle roller 28 is that in doing so, the belt contact state is stable with respect to fluctuation of the running position of the belt 24.

As in the embodiment, the drive roller 25 is located at a position satisfying conditions after passage through the electricity removal corotron pairs 43 and 44 and after passage through the inner face cleaning member 50 and after passage through the rotation brush 45 and the blade 46 of the surface cleaning member, whereby the drive roller 25 drives the transfer belt 24 in a state in which the surface and rear face of the transfer belt 24 have been subjected to electricity removal and cleaned, so that it can drive the transfer belt 24 reliably.

Figure 16:
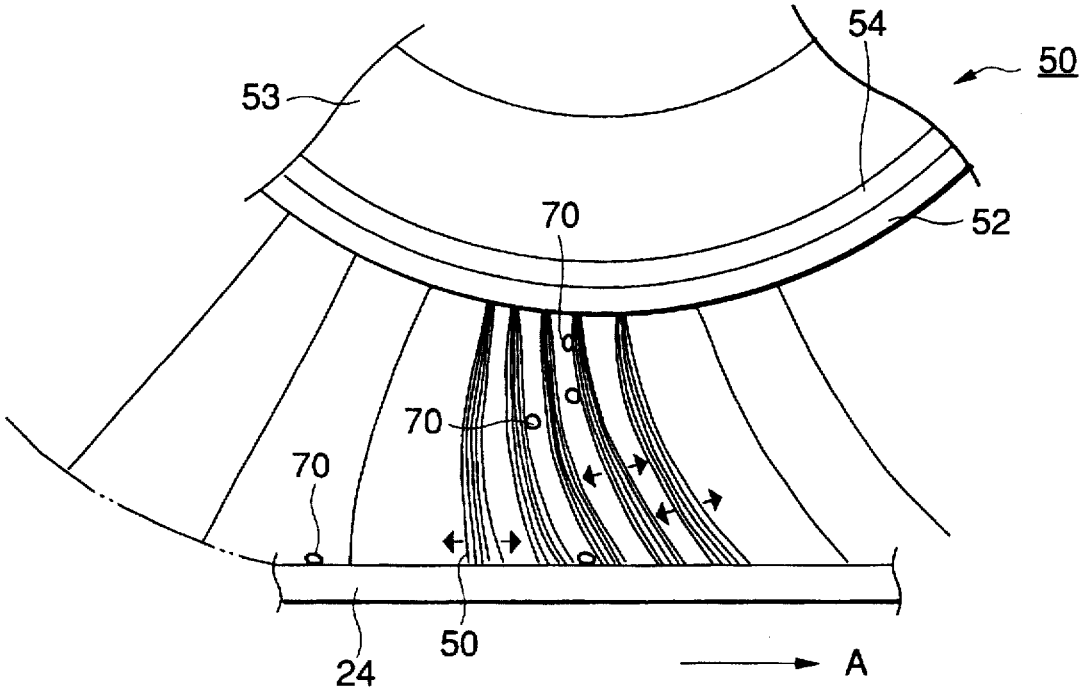
FIG. 16 is a schematic drawing to show a cleaning state of the cleaning member.
Figure 17:
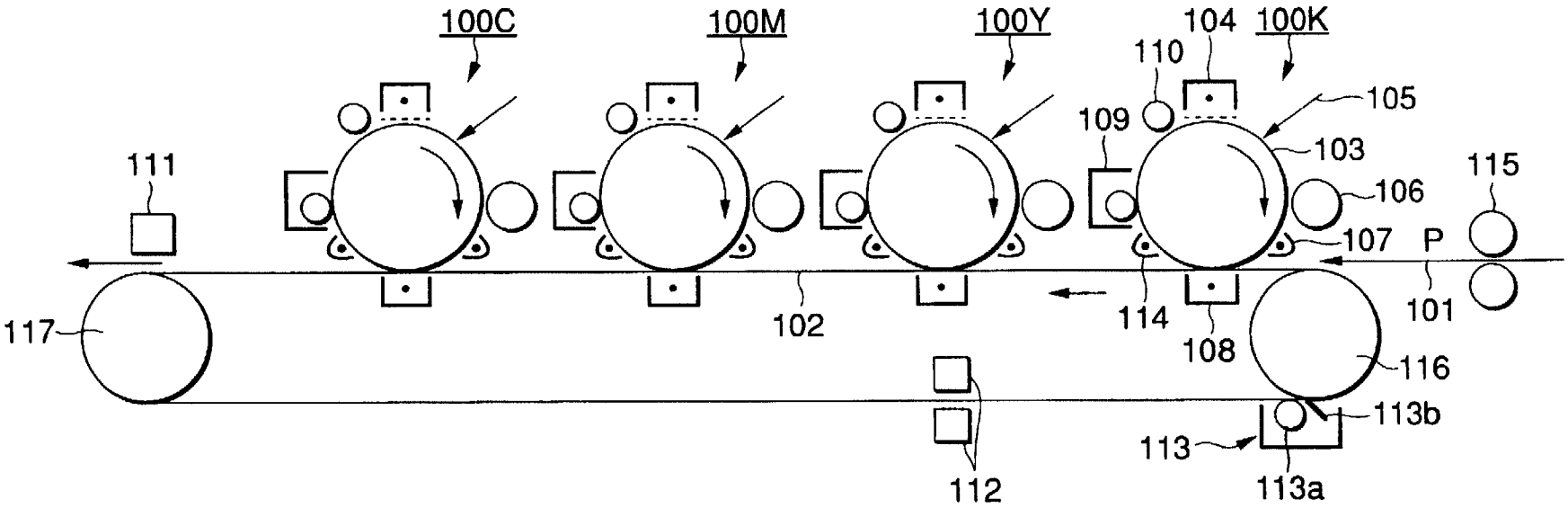
FIG. 17 is a block diagram to show a conventional color image formation apparatus.

By the way, since the cleaning member 50 has extremely fine fibers 51 densely transplanted in set-up relation as shown in FIGS. 1 and 5–7, suspended substances of toner, paper powder, etc., deposited on the inner face of the transfer belt 24 are scratched off and captured by the extremely fine fibers 51 densely transplanted to the cleaning member 50 in set-up relation and are transported to the roots of the extremely fine fibers 51 densely transplanted to the cleaning member 50 in sequence while they are deposited and held on the surfaces of the extremely fine fibers 51, and are held in the extremely fine fibers 51 densely transplanted to the cleaning member 50, as shown in FIG. 16.

Also, since the cleaning member 50 has extremely fine fibers 51 densely transplanted in set-up relation, suspended substances 70 of toner, paper powder, etc., deposited on the inner face of the transfer belt 24 are efficiently scratched off and captured by the extremely fine fibers 51 densely transplanted. At the time, the extremely fine fibers 51 densely transplanted, which are fixed, vibrate minutely as the transfer belt 24 moves, exerting a high scratching-off effect. Moreover, since the cleaning member 50 has extremely fine fibers 51 densely transplanted in set-up relation, the scratching-off effect of the extremely fine fibers 51 is exerted cumulatively and fine suspended substances 70 of toner, paper powder, etc., deposited on the inner face of the transfer belt 24 and suspended substances 70 of dust, hairs, etc., are scratched off and captured reliably.

Further, since the cleaning member 50 has extremely fine fibers 51 densely transplanted in set-up relation, as shown in FIG. 16, fine suspended substances 70 of toner, paper powder, etc., scratched off and captured by the extremely fine fibers 51 are held in a state in which they are deposited on the surfaces of the extremely fine fibers 51 densely transplanted, and the suspended substances 70 deposited on the surfaces of the extremely fine fibers 51 gradually move to the roots of the extremely fine fibers 51 with vibration of the extremely fine fibers 51 coming in contact with the moving transfer belt 24 and are held reliably by means of the extremely fine fibers 51 densely transplanted in set-up relation, whereby they can be securely prevented from being again transferred to the side of the transfer belt 24.

If color images are copied to a large number of sheets of transfer paper 14 with the digital color copier, the cleaning capability of the cleaning member 50 degrades. If a copy is made to about 25,000–40,000 sheets of A4-size transfer paper 14, when the service engineer makes repairs or executes maintenance inspection of the digital color copier, he or she will turn the cleaning member 50 clockwise by 360 degrees/8 via the ratchet member 60 and the plate spring 62 for bringing a new face of the cleaning member 50 into contact with the surface of the transfer belt 24. One turning angle of the cleaning member 50 is set with the ratchet member 60 and the plate spring 62.

Since the digital color copier according to the embodiment is provided on the inner face of the transfer belt 24 with the cleaning member 50 having both the function of capturing substances deposited on the inner face of the transfer belt 24 and the function of holding the deposits, even if substances 70 of toner, paper powder, etc., suspended in the digital color copier are deposited on the inner face of the transfer belt 24, they can be removed reliably by the cleaning member 50 having the function of capturing the deposits 70 and the captured deposits 70 can be held by the cleaning member 50 having also the function of holding the captured deposits 70. Thus, the deposits once captured by the cleaning member 50 are not redeposited on the inner face of the transfer belt 24; an image defect or a running failure of the transfer belt 24 caused by deposition of the suspended substances 70 on the inner face of the transfer belt 24 can be prevented.

We have discussed the case where the cleaning member is shaped like a cylinder in the embodiment, but the cleaning member may be shaped like a flat plate, a polygonal column, etc., as required, of course.

(Second embodiment)

Figure 19:
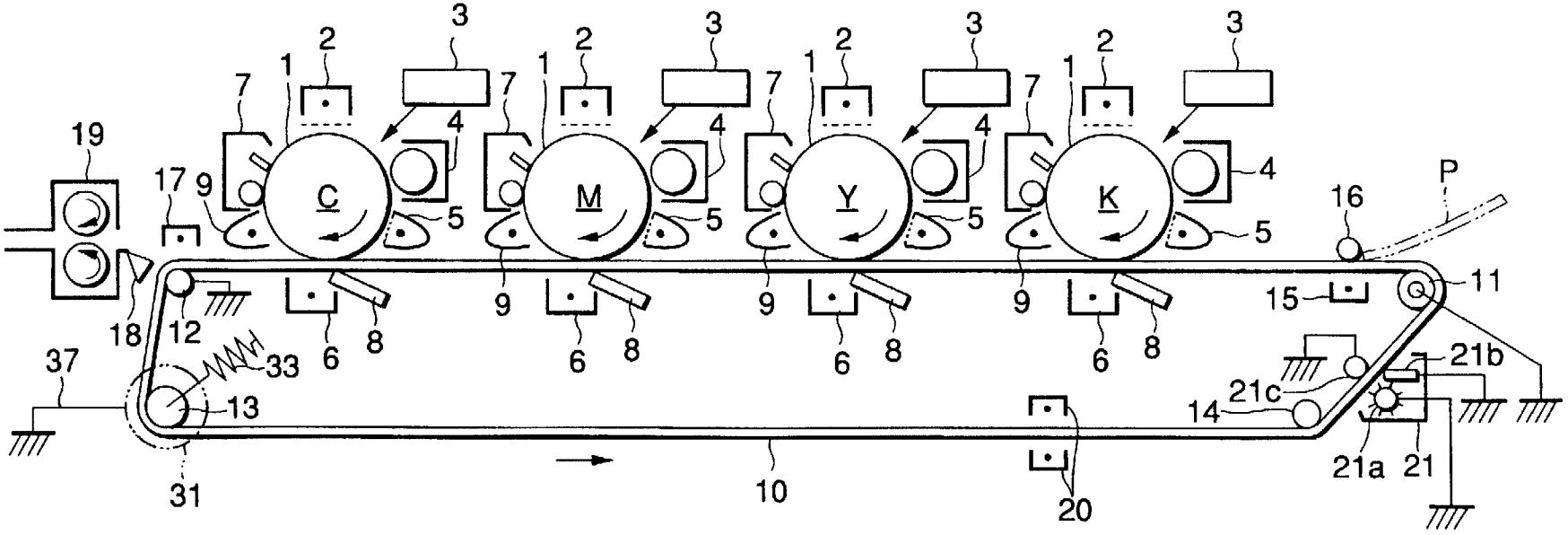
FIG. 19 is a schematic block diagram to show the main section of a color image formation apparatus according to a second embodiment of the invention.
Figure 20:
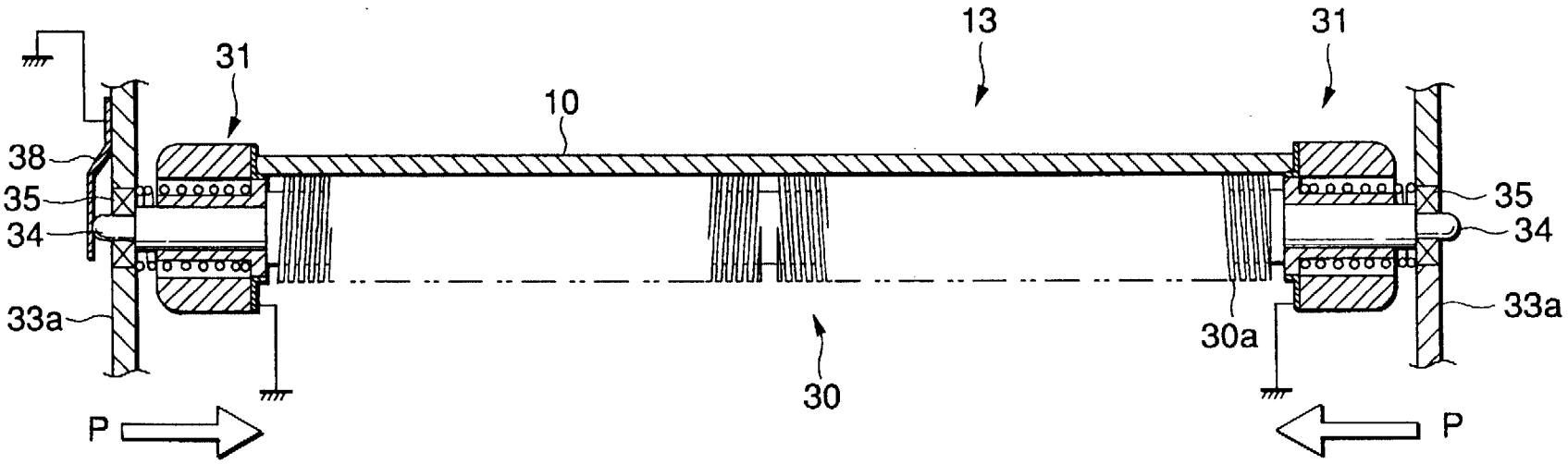
FIG. 20 is a sectional view to show the general structure of a tension giving insulating roll in FIG. 19.
Figure 21:
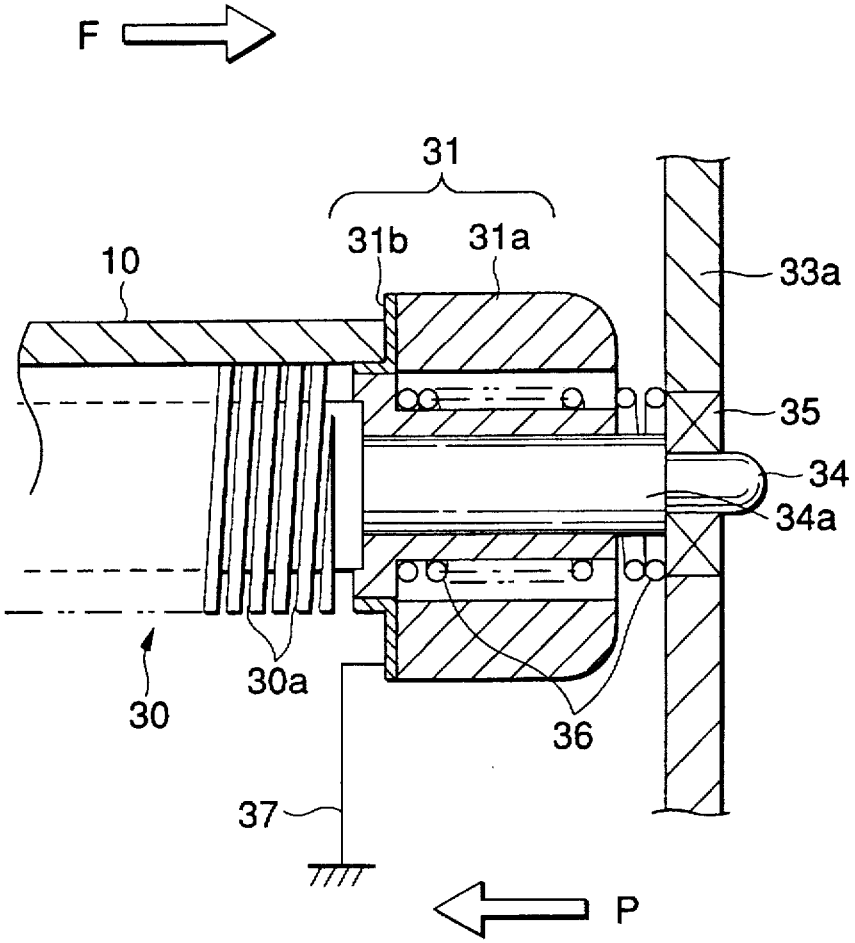
FIG. 21 is an enlarged sectional view of a conductive guide member and its periphery of the roll in FIG. 20.

FIGS. 19–21 show a second embodiment of the invention; FIG. 19 is a schematic block diagram to show the main section of a color image formation apparatus to which the invention is applied, FIG. 20 is a sectional view to show the general structure of a tension giving insulating roll having conductive guide members in FIG. 19, and FIG. 21 is an enlarged view of one end of the roll in FIG. 20.

In FIG. 19, numeral 10 is a dielectric belt for transporting a transfer material. This dielectric belt 10, which is an endless belt about 50–150 μm thick made of a dielectric film of a polyethylene terephthalate film, a polyvinylidene fluoride film, etc., is placed on a drive roll 11, a stripping part roll 12, a tension giving roll 13, and an idler roll 14, and turns in the arrow direction in the figure. Disposed in the surroundings of the transfer material transport belt 10 are an attraction charger 15 and an attraction roll 16 for attracting fed transfer material P onto the belt 10, a stripping charger 17 and a stripping claw 18 for stripping off the transfer material P from the belt 10, a fuser 19 for fixing unfixed toner images on the transfer material P, belt electricity removers 20 for removing electricity of the belt 10, a cleaning unit 21 for removing remaining deposits on the belt 10, and the like.

Of the rolls for supporting the dielectric belt 10, the tension giving roll 13 is disposed at a position most distant from the drive roll 11 and within a belt placement area between the stripping roll 12 and the belt electricity removers 20. It will be discussed in detail later.

Four image formation units K, Y, M, and C for forming black, yellow, magenta, and cyan toner images respectively are disposed near in order on the top face of the transfer material transport dielectric belt 10 within the belt placement area between the drive roll 11 and the stripping roll 12. Each of the image formation units K, Y, M, and C comprises a photosensitive drum 1 as an image support rotating in the arrow direction, and components such as a charger 2, an image exposure unit 3 of laser scanning type, a developing unit 4, a before-transfer charger 5, a transferrer 6, and a cleaning unit 7 are disposed in the surroundings of the photosensitive drum 1. In FIG. 19, numeral 8 is a transfer baffle for pressing the conductive belt 10 and bringing it into contact with the photosensitive drum 1 when necessary, and numeral 9 is a before-cleaning electricity remover of the photosensitive drum 1.

The color image formation apparatus forms a color image as follows:

In each of the image formation units K, Y, M, and C, the photosensitive drum 1 is charged uniformly by the charger 2, then a document image is exposed to light by the image exposure unit 3 for forming an electrostatic latent image on the photosensitive drum. The electrostatic latent image is developed by the developing unit 4 storing the corresponding color (k, y, m, or c) toner and a toner image in the corresponding color is formed on the photosensitive drum 1. On the other hand, a transport material stored in a paper feed tray is transported near the transfer material transport dielectric belt 10 by paper feed means (not shown), then is attracted electrostatically on the belt 10 by the attraction charger 15 and the attraction roll 16 and is transported to a transfer position coming in contact with the photosensitive drum 1. The toner images formed on the photosensitive drums 1 are adjusted to the optimum charge state for transfer by the before-transfer chargers 5 as required, then are transferred to the transfer material P on the transfer material transport belt 10 in overlap relation in sequence while they are subjected to the action of the transferrers 6. After the completion of the transfer, the transfer material P is stripped off from the belt 10 by the stripping action of the stripping charger 17 and the stripping claw 18 and is sent to the fuser 19 for fixing, then is discharged to the outside of the machine, whereby the transfer material on which a color image is formed is provided.

After the completion of the transfer process, the photosensitive drums 1 are cleaned by the cleaning units 7 and are subjected to electricity removal, then repeat the image formation process or stand by for another image formation process. On the other hand, the transfer material transport belt 10 from which the transport material P has been stripped off is subjected to electricity removal by the electricity removers 20, then is cleaned by the cleaning unit 21.

FIGS. 20 and 21 are sectional views to show the above-mentioned tension giving roll 13. This tension giving roll 13 consists of an insulating roll part 30 and conductive guide members 31 pivotally supported on both sides of the roll, as shown in FIGS. 19–21. It is fixed to a belt frame via tension giving mechanisms 33, thereby giving such a tension as to turn the transfer material transport dielectric belt 10 under a proper tension.

As shown in FIGS. 20 and 21, the insulating roll part 30 is provided by attaching to a shaft 34 a rubber material formed with a large number of coil-like slits 30*a* axially on the surface and shaped like a roll (preferably, the rubber material has a resistance value of $10^{12}\Omega$ or more). From the viewpoint of suppressing a snaking phenomenon of the belt more efficiently, the slits 30*a* are formed in a spiral slit pattern such that the slits are turned spirally from both left and right ends of the roll toward the center and match finally at the center of the roll. The shaft 34 is supported rotatably on tension giving arms 33*a* of the tension giving mechanisms 33 via bearings 35, whereby the insulating roll part 30 also rotates integrally with the shaft 34. In the embodiment, roll parts of the stripping roll 12 and the idler roll 14 are also formed almost similarly to the insulating roll part 30. (However, the spiral patterns of slits of the rolls 12 and 14 are turned in an opposite direction to the spiral pattern of the insulating roll part 30 from the viewpoint of suppressing a snaking phenomenon of the belt more efficiently.)

On the other hand, each of the conductive guide members 31 consists of a substantially cylindrical guide main body 31*a* made of a resin molded article and an L-letter cross-section metal guide part 31*b* fitted to the guide main body 31*a*. The guide main body 31*a* is pivotally supported on a sliding contact part 34*a* of the shaft movably in the axial direction and is energized in the arrow P direction by a spring 36 placed between the guide main body 31*a* and the bearing 35 so as to normally abut the side end of the insulating roll part 30. The conductive guide members 31 do not rotate and can only move axially.

In the tension giving roll 13, the metal guide parts 31*b* of the conductive guide members 31 coming in contact with the side ends of the dielectric belt 10 are grounded. In the embodiment, also grounded are the stripping roll 12, which is a part coming in contact with the dielectric belt before the belt electricity removers 20, and a conductive brush roll 21*a*, a cleaning blade 21*b*, and a brush opposed roll 21*c* of the belt cleaning unit 21 and the drive roll 11, which are parts coming in contact with the dielectric belt behind (downstream from) the belt electricity removers 20. In FIGS. 19 and 21, numeral 37 denotes a ground wire.

The transfer material transport dielectric belt 10 is turned via the rolls by a turn drive force of the drive roll 11 under a proper tension given by the tension giving roll 13. Moreover, when the belt is turned, snaking run is controlled by the conductive guide members 31 of the tension giving roll 13. That is, the belt 10 is turned while the side ends thereof are coming in contact with the metal guide parts 31*b* of the conductive guide members 31. Thus, if the belt side end presses the conductive guide member 31 in the arrow F direction in FIG. 21 because of asperities on the margins, snaking, etc., the guide member 31 moves axially while it is energized by the spring 36, thereby controlling snaking. This snaking control effect is exerted most efficiently because the tension giving roll 13 is disposed at a position most distant from the drive roll 11.

Figure 22:
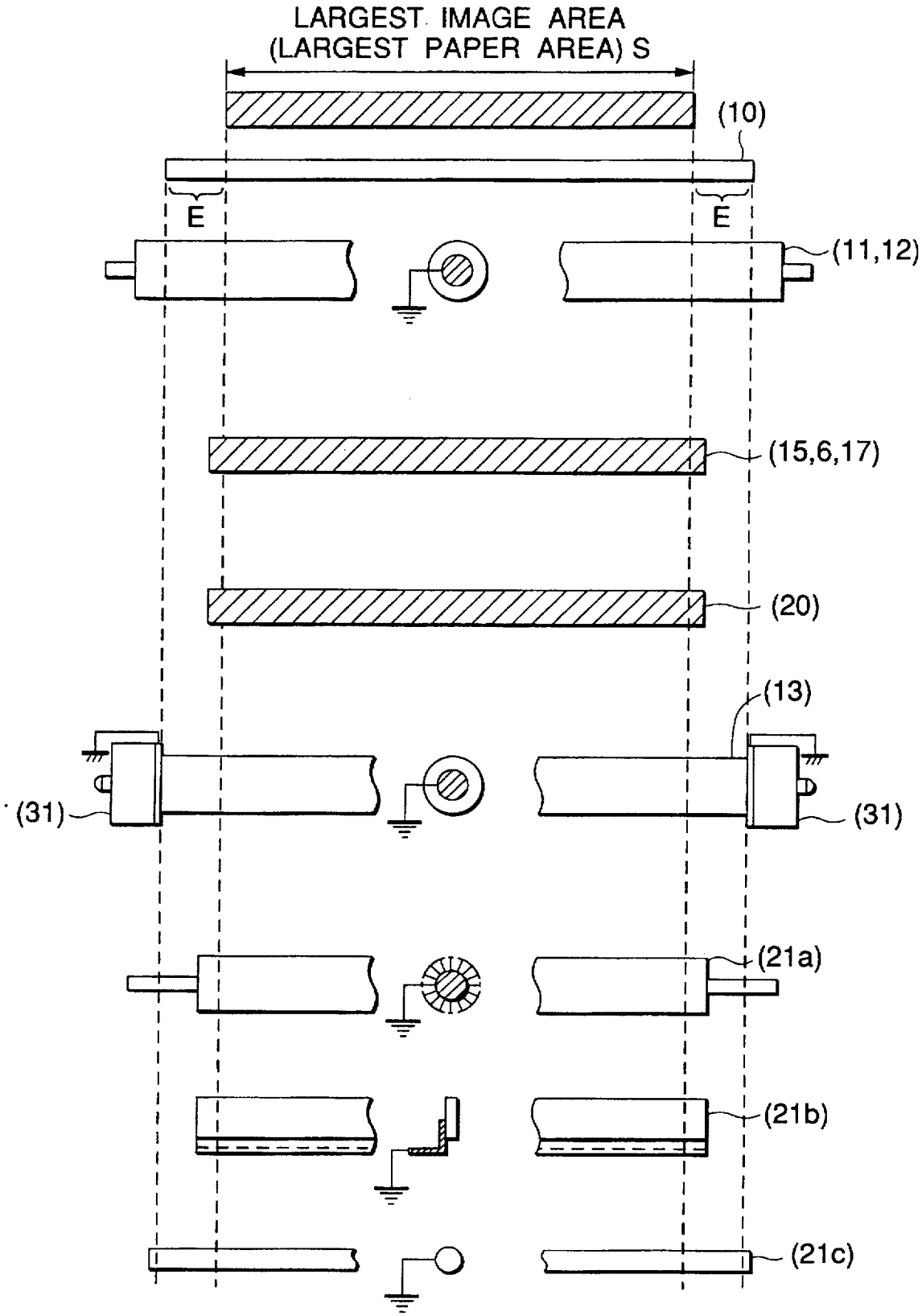
FIG. 22 is an illustration to show the width relationship between a dielectric belt and members coming in contact therewith and grounding.

The transfer material transport dielectric belt 10 generally is turned while repeating a cycle of passing through electrostatic attraction (transport) of a transfer material, a transfer step at each transfer position, and a stripping step in order, then an electricity removal step by the belt electricity removers 20 and preparing for the next transfer material attraction. Formerly, electricity removal of the dielectric belt 10 was executed only by the belt electricity removers 20. As shown in FIG. 22, electricity removal by the belt electricity removers 20 is executed only in the area corresponding to the largest image formation (paper holding transport) area S of the full-width area of the dielectric belt 10, and is not executed in other belt areas E. The width (charging width) of each of the attraction charger 15, the transferrer 6, and the stripping charger 17 is almost equal to that of the largest image formation area S, needless to say.

In contrast, in the apparatus of the embodiment, after completion of transfer and stripping steps, the dielectric belt 10 is subjected to electricity removal first by the stripping roll and the conductive guide members 31 of the tension giving roll 13, then by the belt electricity removers 20, thereby also efficiently removing charges produced by stripping discharge occurring between the transfer material stripped off in the stripping part and the belt. Further; after electricity removal by the belt electricity removers 20, electricity removal by the conductive brush roll 21*a*, the cleaning blade 21*b*, and the brush opposed roll 21*c* of the belt cleaning unit 21 and final electricity removal by the drive roll 11 are also executed.

Thus, all the area of the transfer material transport dielectric belt 10 before attracting another transfer material can be electricity-removed efficiently and evenly. Both end areas other than the image area of the dielectric belt 10, E, formerly not electricity-removed is also electricity-removed reliably. Further, the side ends (edges) of the dielectric belt 10 is also electricity-removed reliably by the conductive guide members 31 of the tension giving roll 13.

Therefore, if the apparatus of the embodiment forms an image, trouble such as apparatus malfunction caused by insufficient electricity removal, uneven electricity removal, etc., can be prevented securely; resultantly, good image formation can be executed stably.

(Third embodiment)

Figure 23:
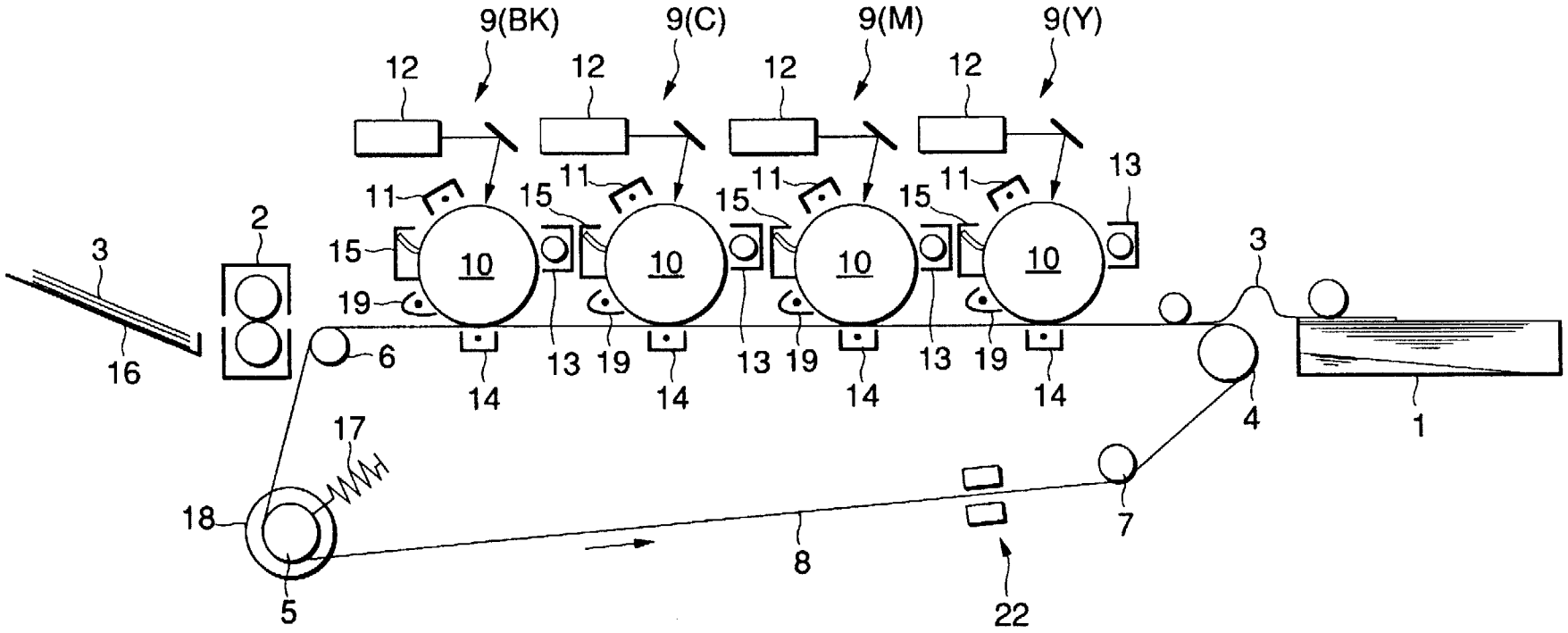
FIG. 23 is a schematic block diagram to show an embodiment of a color copier to which the invention is applied.

FIG. 23 shows an example of a color electrophotographic copier to which the invention is applied.

Specifically, an endless transfer belt 8 is placed on a drive roll 4, an edge guide roll, and driven rolls 6 and 7 on a transport passage of a recording sheet 3 for joining a recording sheet supply tray 1 and a fuser 2, and four image formation units 9 for forming toner images corresponding to yellow Y, magenta M, cyan C, and black BK by an electrophotographic process are spaced properly from each other on one side of the transfer belt 8.

Each image formation unit 9 has a charge corotron 11, a laser beam scanning unit 12, a developing unit 13, a transfer corotron 14, and a cleaner 15 placed in the surroundings of a photosensitive drum 10, and forms a toner image responsive to image information of the corresponding color on the photosensitive drum 10 by a so-called reverse developing apparatus. That is, the photosensitive drum 10 is minus charged uniformly by the charge corotron 11 and a negative latent image is formed on the photosensitive drum 10 by light exposure of the laser beam scanning unit 12 and is developed with negative charge toner of the same polarity as the charge polarity of the photosensitive drum 10. The transfer corotron 14 gives charges of the opposite polarity to the toner and the photosensitive drum 10, namely, plus charges to the rear face of the transfer belt 8, whereby the toner image developed with the negative charge toner is transferred to the recording sheet 3 transported on the transfer belt 8.

Each image formation unit 9 has a before-cleaning electricity remover (PCC) 19 disposed preceding the cleaner 15. An AC voltage on which a minus DC voltage is superposed is applied to the PCC 19, and while minus charges are being given to the surface of the photosensitive drum 10 passing through the transfer part of the toner image, a latent image history on the photosensitive drum 10 is removed.

In the image formation apparatus of the embodiment thus configured, a recording sheet 3 transported from the supply tray 1 is electrostatically attracted to the transfer belt 8 at a predetermined timing and as the transfer belt 8 moves, color toner images are transferred to the recording sheet 3 in sequence from the image formation units 9, 9, . . . Therefore, a full color toner image with four color toner images overlapping each other is completed on the recording sheet 3 passing through the black BK image formation unit 9. The recording sheet 3 to which the toner image has been transferred is stripped off from the transfer belt 8, then is sent out via the fuser 2 to a discharge tray 16 and the color record image formation is completed.

Figure 24:
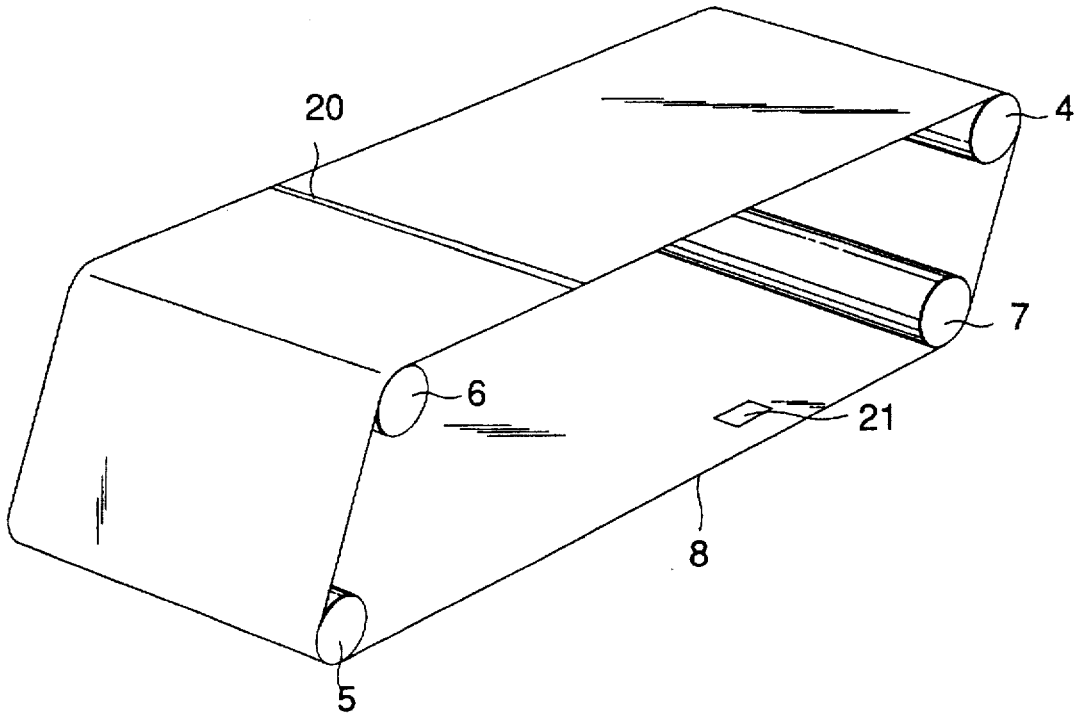
FIG. 24 is a perspective view to show a transfer belt according to the embodiment.

On the other hand, as shown in FIG. 24, the transfer belt 8 is formed like an endless belt by ultrasonic welding of both ends of a dielectric film 75 μm thick and a seam part 20 produced by the ultrasonic welding exists in one place of the circumference of the transfer belt 8. The transfer belt 8 is placed on four rolls including the drive roll 4 and the edge guide roll 5 and is given a predetermined tension by the edge guide roll 5 energized by a spring 17.

A reference hole 21 for detecting a turn position of the transfer belt 8 is made in one place of the circumference of the transfer belt 8. A transmission-type photosensor 22 disposed in the turn passage of the transfer belt 8 detects the reference hole 21, thereby finding out the turn position of the seam part 20.

Since asperities are formed in the seam part 20 of the transfer belt 8, paper powder of the recording sheet 3 and toner easily enter the seam part 20 and a resistance value in the thickness direction of the transfer belt is prone to lower in the seam part 20. On the other hand, plus charges for electrostatically attracting the recording sheet 3 onto the transfer belt 8 and those for transferring toner images to the recording sheet 3 exist on the rear face of the transfer belt 8. Therefore, when the seam part 20 passes through the transfer part where the transfer corotron 14 is disposed and comes in contact with the photosensitive drum 10, the plus charges on the rear face of the transfer belt 8 flow into the photosensitive drum 10 through the seam part 20 low in resistance and are injected into a partial area of the photosensitive drum 10 used in minus charges. The amount of the plus charges existing on the rear face of the transfer belt 8 increases as toner image transfer is repeated. Therefore, if the injection amounts of the plus charges are compared with respect to the adjacent photosensitive drums 10, the injection amount of the plus charges increases as the photosensitive drum 10 is positioned more downstream in the turn direction of the transfer belt 8.

Figure 25A:
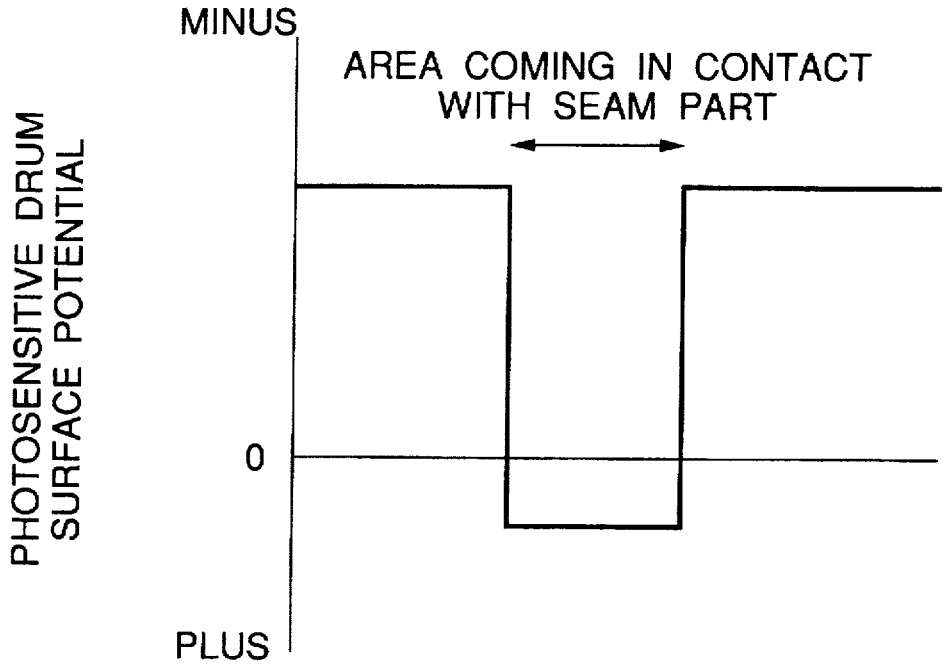
FIG. 25A and 25B is potential charts to show surface potential of a photosensitive drum coming in contact with a seam part of the transfer belt, indicating a potential state when the invention is not applied.
Figure 25B:
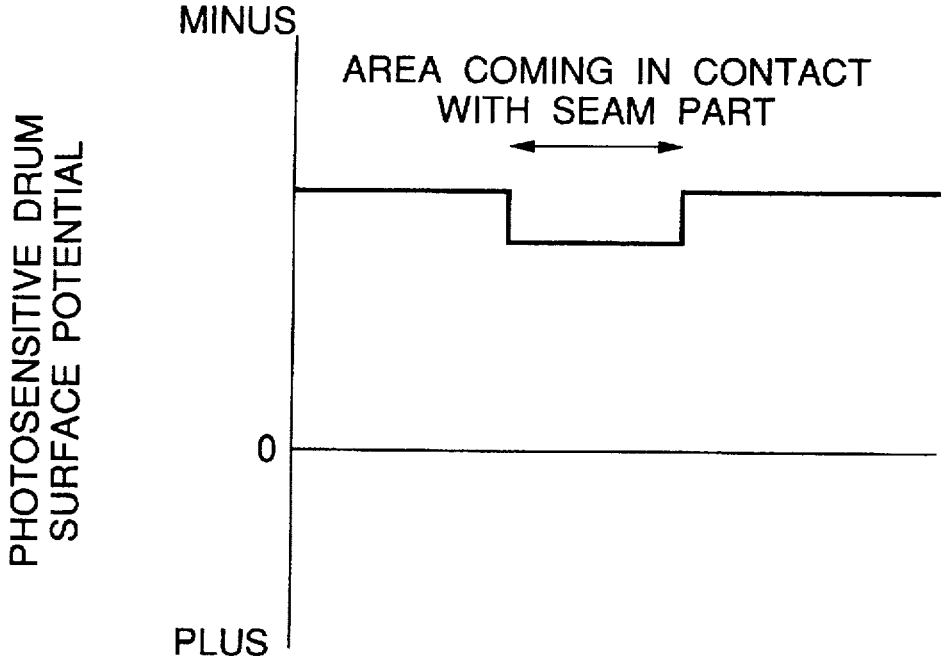

Resultantly, for the surface potential on the photosensitive drum 10 passing through the transfer part, only the area coming in contact with the seam part 20 is plus charged, as shown in FIG. 25A. When plus charges thus remain on the surface of the photosensitive drum 10, even if minus charges are given to the photosensitive drum 10 with the charge corotron 11, they are neutralized by the remaining plus charges; for the surface potential on the photosensitive drum 10 passing through the charge corotron 11, charge potential lowers only in the area coming in contact with the seam part 20, as shown in FIG. 25B. Thus, a horizontal stripe corresponding to the seam part 20 occurs in the toner image formed on the photosensitive drum 10, remarkably impairing the quality of the formed color image.

Then, in the embodiment, discharge output of the PCC 19 is changed from low to high at the timing at which the area on the photosensitive drum 10 coming in contact with the seam part 20 passes through the opposed position to the PCC 19, and a larger amount of minus charges are injected by the PCC 19 into the area on the photosensitive drum 10 than other areas. After the area on the photosensitive drum 10 coming in contact with the seam part 20 passes through the opposed position to the PCC 19, again the discharge output of the PCC 19 is changed from high to low. Since the amount of plus charges injected into each photosensitive drum 10 varies depending on contact with the seam part 20, the high output of the PCC 19 of the image formation unit 9 positioned more downward in the turn direction of the transfer belt 8 is set larger. That is, high discharge output of the PCC 19 increases in the order of the image formation units Y, M, C, and BK.

Figure 26:
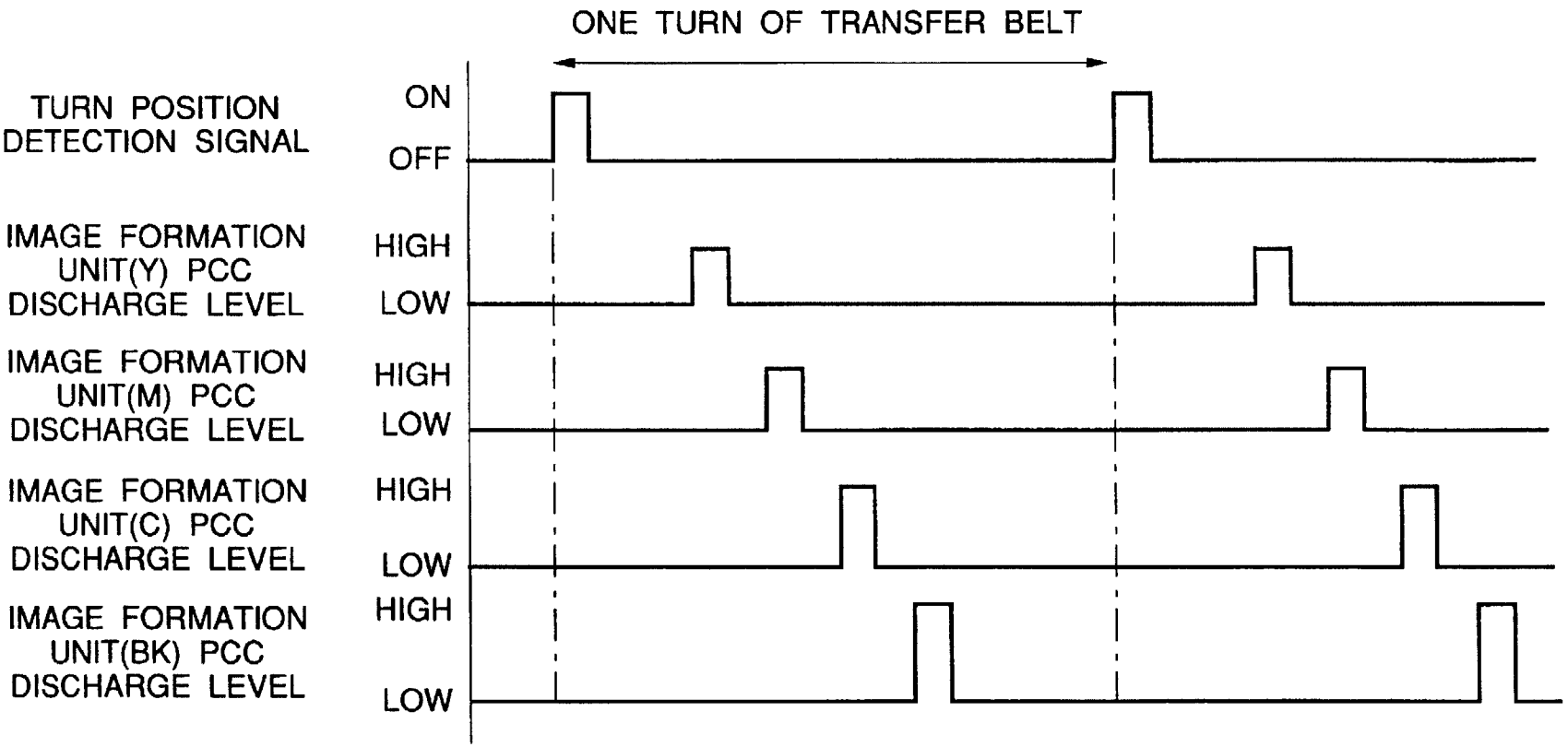
FIG. 26 is a timing chart to show the discharge output change timings of PCCs in the embodiment.

FIG. 26 is a timing chart to show the discharge level change timings of the PCCs 19 for the Y, M, C, and BK image formation units 9.

Since the turn position of the seam part 20 can be known by the photosensor 22 which detects the reference hole 21 of the transfer belt 8, the embodiment determines the discharge output change timing of the PCC 19 based on the turn position detection signal of the transfer belt 8 generated by the photosensor 22. That is, the time required between the turn position detection signal being input and the seam part 20 of the transfer belt 8 passing through the transfer part of the yellow Y image formation unit 9 can be previously calculated from the positional relationship between the reference hole 21 and the seam part and the process speed of the transfer belt 8. The time required for the area on the photosensitive drum 10 coming in contact with the seam part 20 to move to the opposed position to the PCC 19 can also be previously calculated from the circumferential length and process speed of the photosensitive drum 10.

Therefore, the discharge output of the PCC 19 of the yellow Y image formation unit 9 is changed at a predetermined timing synchronized with the turn position detection signal, whereby the PCC 19 can be operated at high level only in the area on the photosensitive drum 10 coming in contact with the seam part 20.

Likewise, for the magenta M, cyan C, and black BK color image formation units 9, the discharge output of the PCC 19 may be changed at a predetermined timing synchronized with the turn position detection signal by adding the time taken for the seam part 20 to move between the transfer parts of the adjacent image formation units 9.

Figure 27A:
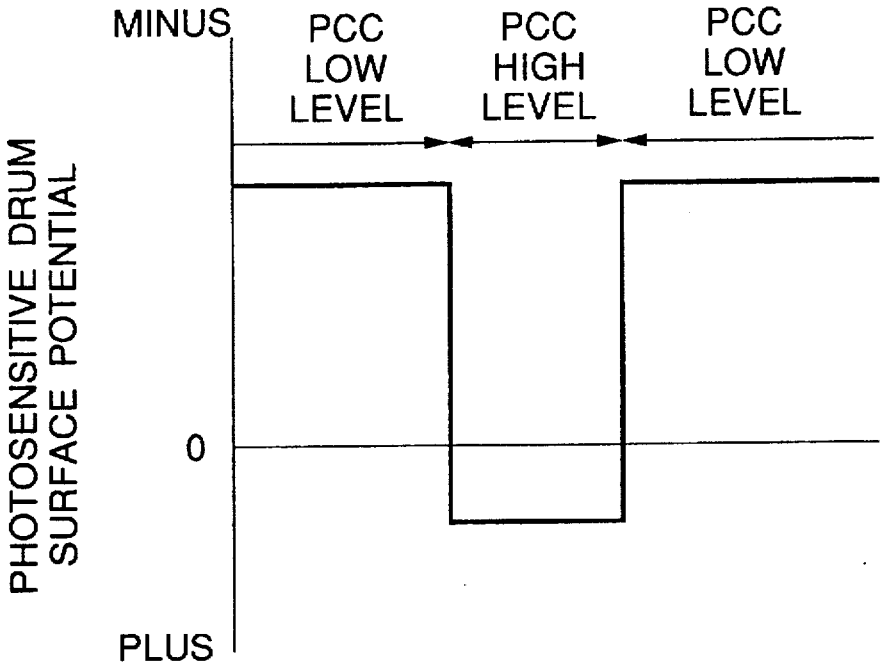
FIG. 27A and 27B is potential charts to show surface potential of a photosensitive drum coming in contact with the seam part of the transfer belt, indicating a potential state when the invention is applied.
Figure 27B:
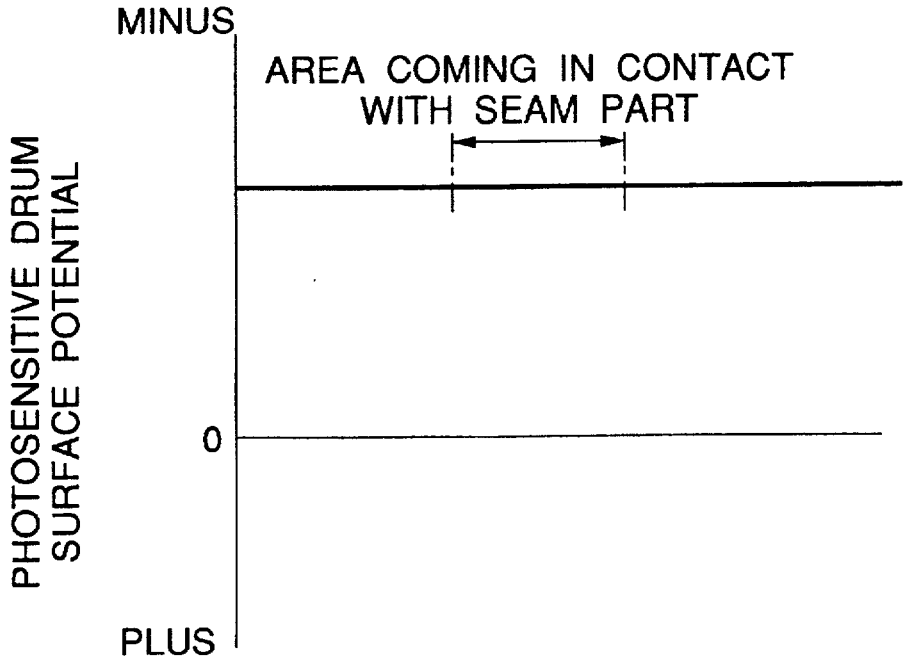
Figure 28:
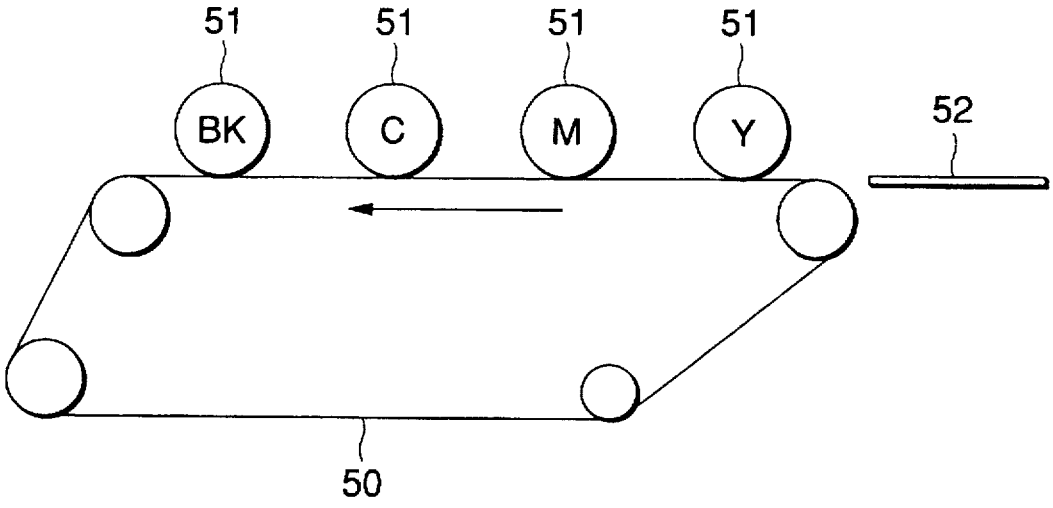
FIG. 28 is a schematic block diagram to show a so-called tandem color copier using a transfer belt for transporting a recording sheet.
Figure 29:
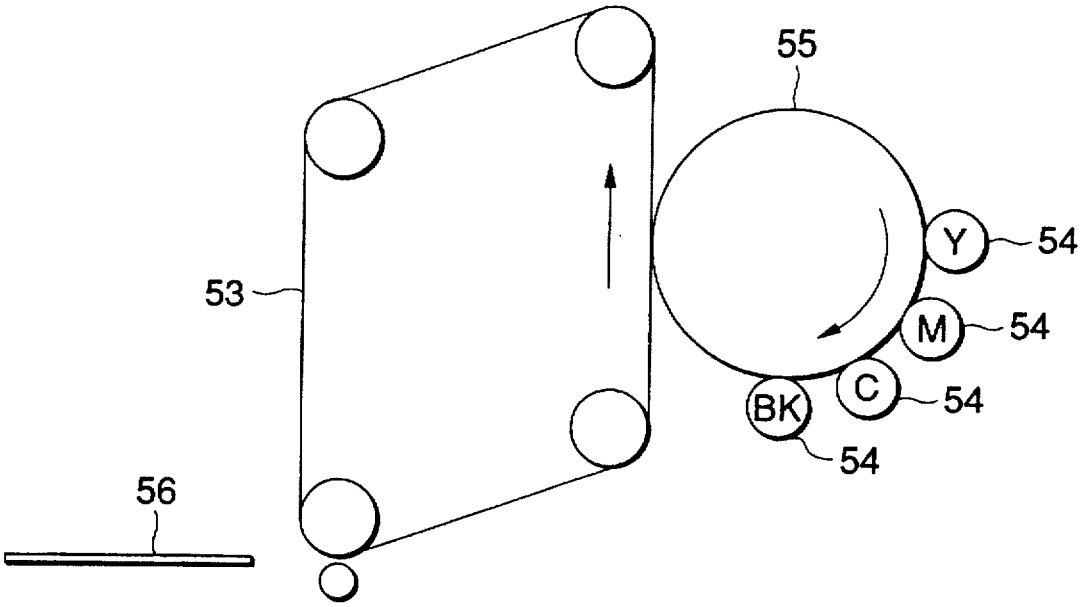
FIG. 29 is a schematic block diagram to show a color copier using a transfer belt as an intermediate transfer body.

Thus, the PCC 19 is operated at high level in the area on the photosensitive drum 10 coming in contact with the seam part 20 of the transfer belt 8, as shown in FIG. 27A; excessive minus charges are injected into the area as compared with other areas and the plus charges existing in the area are neutralized by the excessive minus charges. Resultantly, no plus charges exist on the photosensitive drum 10 passing through the PCC 19, thus the surface of the photosensitive drum 10 passing through the charge corotron 11 is charged at uniform minus potential, as shown in FIG. 27B.

Therefore, according to the color copier of the embodiment, a horizontal stripe corresponding to the seam part 20 does not occur in a toner image in the toner image formation cycle just after the photosensitive drum 10 comes in contact with the seam part 20 of the transfer belt 8; a high-quality color image can be formed.

(Fourth embodiment)

Figure 30:
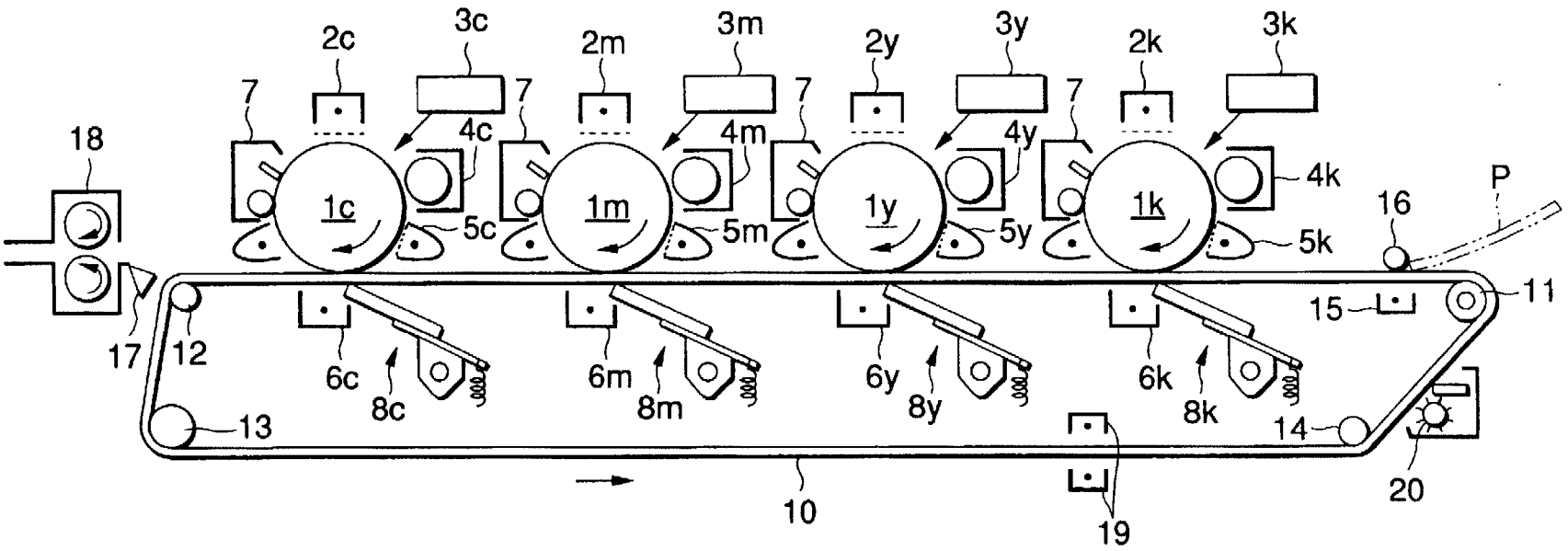
FIG. 30 is a schematic block diagram to show the main section of a color image formation apparatus according to a fourth embodiment of the invention.
Figure 31:
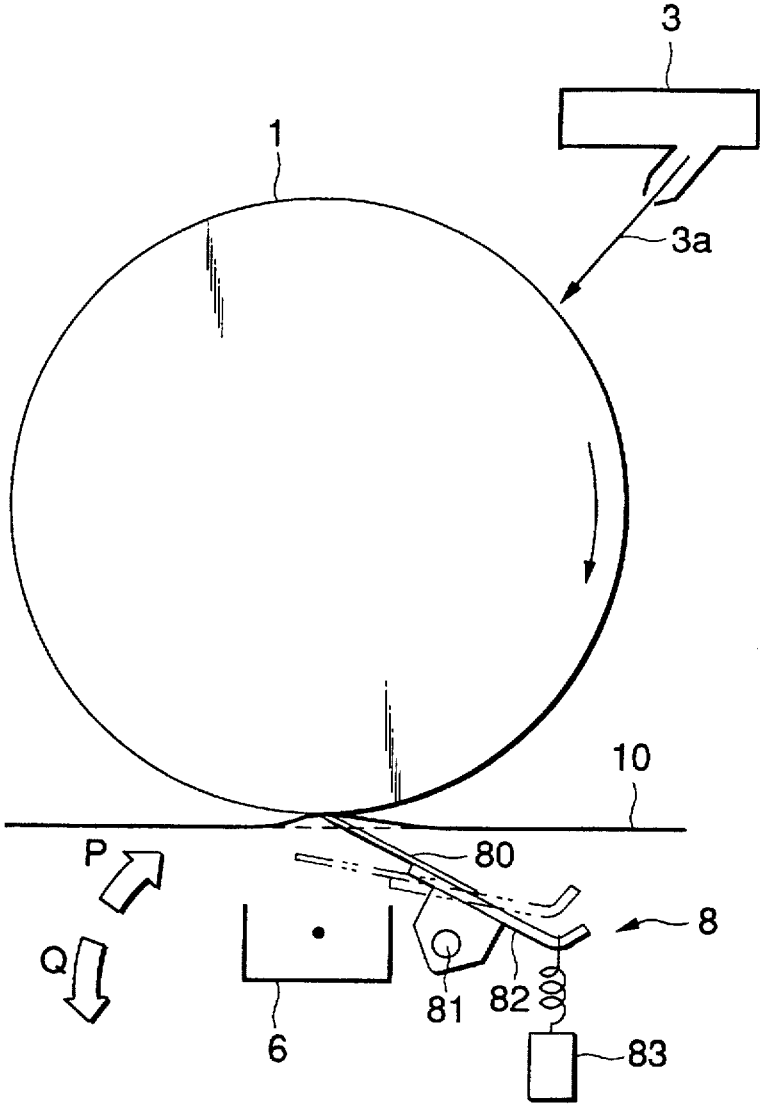
FIG. 31 is an enlarged view to show press means (transfer baffle) and its periphery.

FIGS. 30 and 31 show a fourth embodiment of the invention; FIG. 30 is a schematic block diagram to show the main section of a color image formation apparatus and FIG. 31 is an enlarged view to show press means and its periphery.

The color image formation apparatus comprises photosensitive drums 1*k*, 1*y*, 1*m*, and 1*c* as image supports rotating in the arrow direction. Components such as a charger 2, an image exposure unit 3 of laser scanning type, a developing unit 4, a before-transfer charger 5, a transferrer 6, and a cleaning unit 7 are disposed in the surroundings of each of the four photosensitive drums 1*k*, 1*y*, 1*m*, and 1*c*, whereby k (black), y (yellow), m (magenta), and c (cyan) toner images are formed on the photosensitive drums 1*k*, 1*y*, 1*m*, and 1*c* respectively.

For example, if the color image formation apparatus is formed as a digital color copier, an original document set on a document bed (not shown) is read through a color image reader, the read signals are converted into digital image signals by image signal processing means, and the digital image signals are temporarily stored in a memory, then four color toner images are formed based on the stored 4-color (k, y, m, c) digital image signals. That is, the image exposure units 3*k*, 3*y*, 3*m*, and 3*c* are driven in response to the 4-color digital image signals input from the image signal processing means for writing electrostatic latent images onto the photosensitive drums 1*k*, 1*y*, 1*m*, and 1*c* uniformly charged by the chargers 2*k*, 2*y*, 2*m*, and 2*c*. The electrostatic latent images are developed by the developing units 4*k*, 4*y*, 4*m*, and 4*c* storing k toner, y toner, m toner, and c toner, forming k, y, m, and c toner images. If the color image formation apparatus is formed as a printer, etc., color toner images may be formed based on image signals input to the image signal processing means from an external apparatus, etc.

The color image formation apparatus has a transfer material transport belt 10 made of a seamless belt placed near the four photosensitive drums 1*k*, 1*y*, 1*m*, and 1*c* in a noncontact state on the lower sides which become the transfer positions of the photosensitive drums 1*k*, 1*y*, 1*m*, and 1*c*. The transfer material transport belt 10 is placed on a drive roll 11, a stripping roll 12, a tension roll 13, an idler roll 14, etc., and turns in the arrow direction. Transfer baffles 8 as press means are placed before the transferrers 6*k*, 6*y*, 6*m*, and 6*c* disposed on the opposite side to the photosensitive drums 1 of the transfer material transport belt 10. Further, disposed in the surroundings of the transfer material transport belt 10 are an attraction charger 15 and an attraction roll 16 for attracting fed transfer material P onto the belt 10, a stripping claw 17 for stripping off the transfer material P from the belt 10, a fuser 18 for fixing unfixed toner images on the transfer material P, belt electricity removers 19 for removing electricity of the belt 10, a cleaning unit 20 for removing remaining deposits on the belt 10, and the like. A plurality of transfer materials P can be attracted and held in holding areas and be transported at the same time on the transfer material transport belt 10.

As shown in FIG. 31, the transfer baffle 8 has the main section made up of a flexible press member 80, a support member 82 rotating about a support shaft 81 for supporting the press member 80, and a retracting mechanism 83 for rotating the support member 82 by a predetermined amount in the arrow P or Q direction. To perform the press operation of the transfer baffle 8, the support member 82 is rotated in the arrow P direction by the retracting operation of the retracting mechanism 83 for causing the tip of the press member 80 to slightly push up the transfer material transport belt 10, thereby bringing the belt 10 into contact with the surface of the photosensitive drum 1. On the other hand, to release the press operation of the transfer baffle 8, the support member 82 is rotated in the arrow Q direction by the retracting mechanism 83 for moving the tip of the press member 80 away from the inner face of the belt 10, thereby placing the belt 10 out of contact with the photosensitive drum 1. The on/off operation timing of the transfer baffle 8 will be discussed later.

The color toner images formed on the photosensitive drums 1*k*, 1*y*, 1*m*, and 1*c* are adjusted to the optimum charge state for transfer by the before-transfer chargers 5 as required, then are transferred to the transfer material P attracted and transported on the transfer material transport belt 10 in overlap relation in sequence while they are subjected to the action of the transferrers 6. That is, the transfer material P is transported on the belt 10 and passes through the transfer positions of the photosensitive drums 1*k*, 1*y*, 1*m*, and 1*c* coming in contact with the belt 10 in order, whereby the toner images are transferred in overlap relation. After the completion of the transfer step on the photosensitive drum 1*c*, the transfer material P on which the toner images have been formed is stripped off from the belt 10 by the stripping claw 17 and is sent to the fuser 18 for fixing, then is discharged to the outside of the machine.

After the completion of the transfer process, the photosensitive drums are cleaned by the cleaning units 7 and are subjected to electricity removal, then repeat the image formation process or stand by for another image formation process. On the other hand, the transfer material transport belt 10 from which the transport material P has been stripped off is subjected to electricity removal by the electricity removers 19, then is cleaned by the cleaning unit 20.

By the way, in such an image formation apparatus, if vibration, etc., occurring at the on/off operation time of the transfer baffle 8 propagates to the photosensitive drum 1 during latent image formation of the image exposure unit 3, for example, delicate displacement of the photosensitive drum 1 causes the irradiation position with exposure light 3*a* to shift, causing poor image quality.

Figure 32:
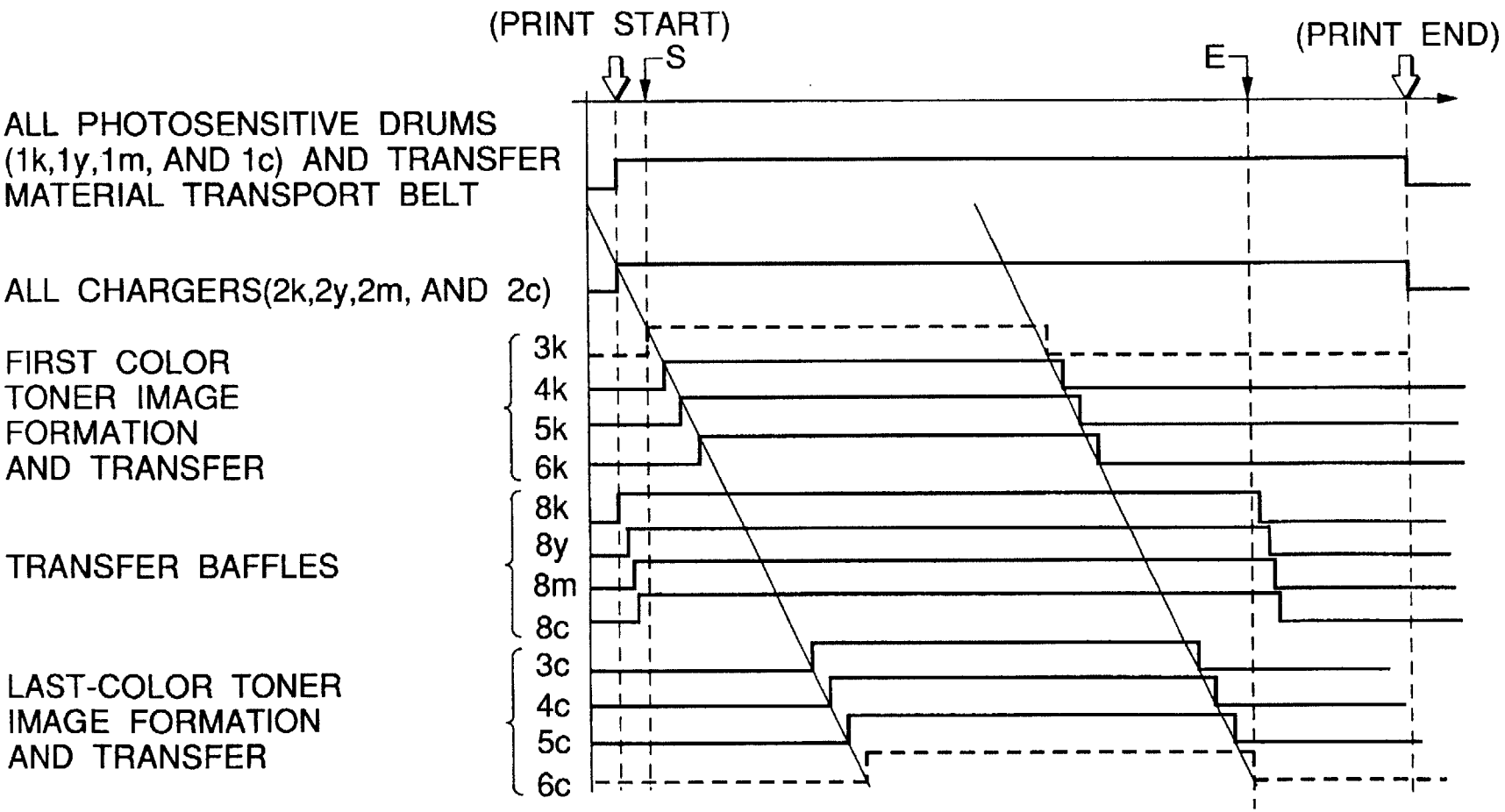
FIG. 32 is a timing chart to show a basic example of the press means on/off operation timings.
Figure 33:
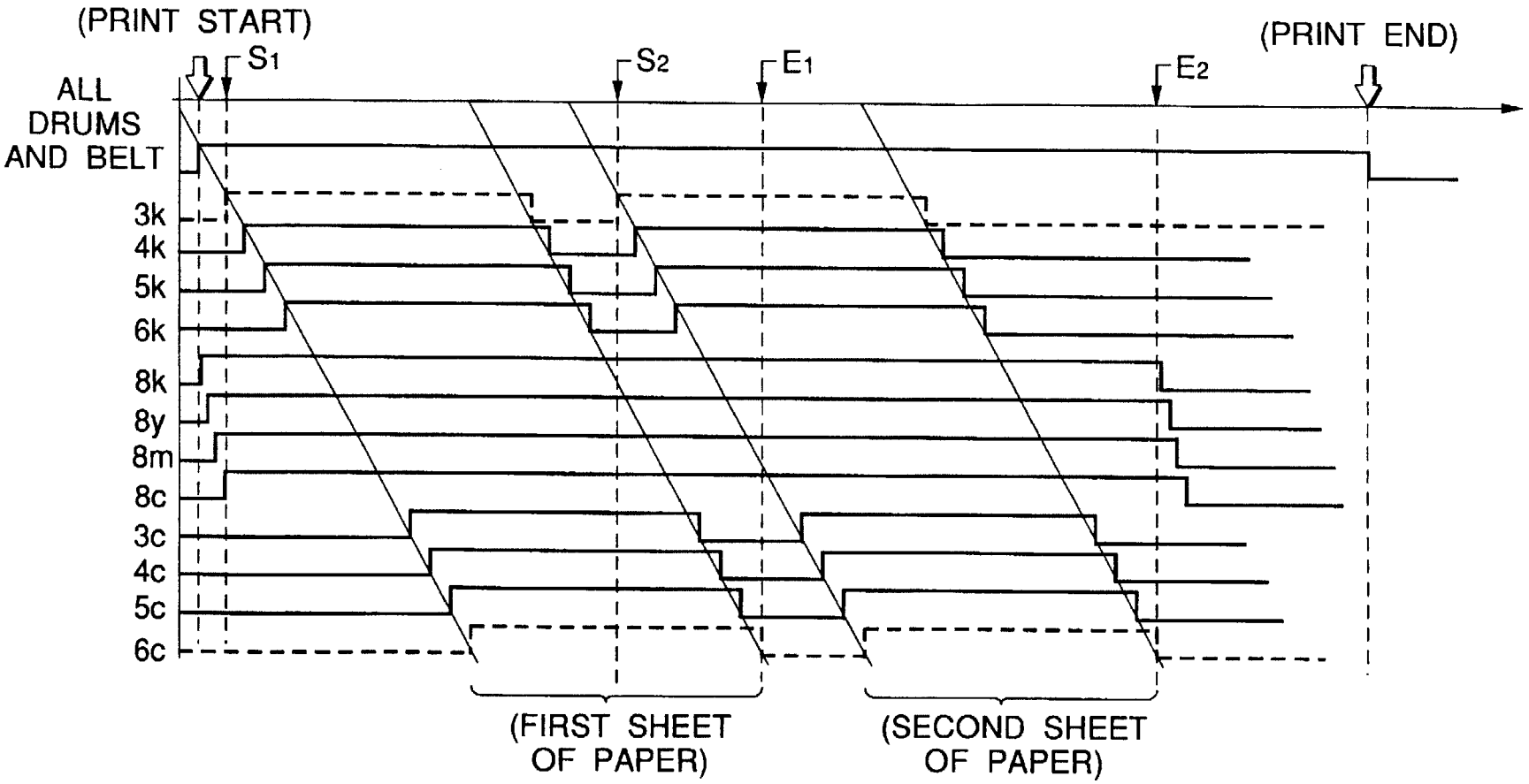
FIG. 33 is a timing chart to show an irregular example of the press means on/off operation timings.
Figure 34:
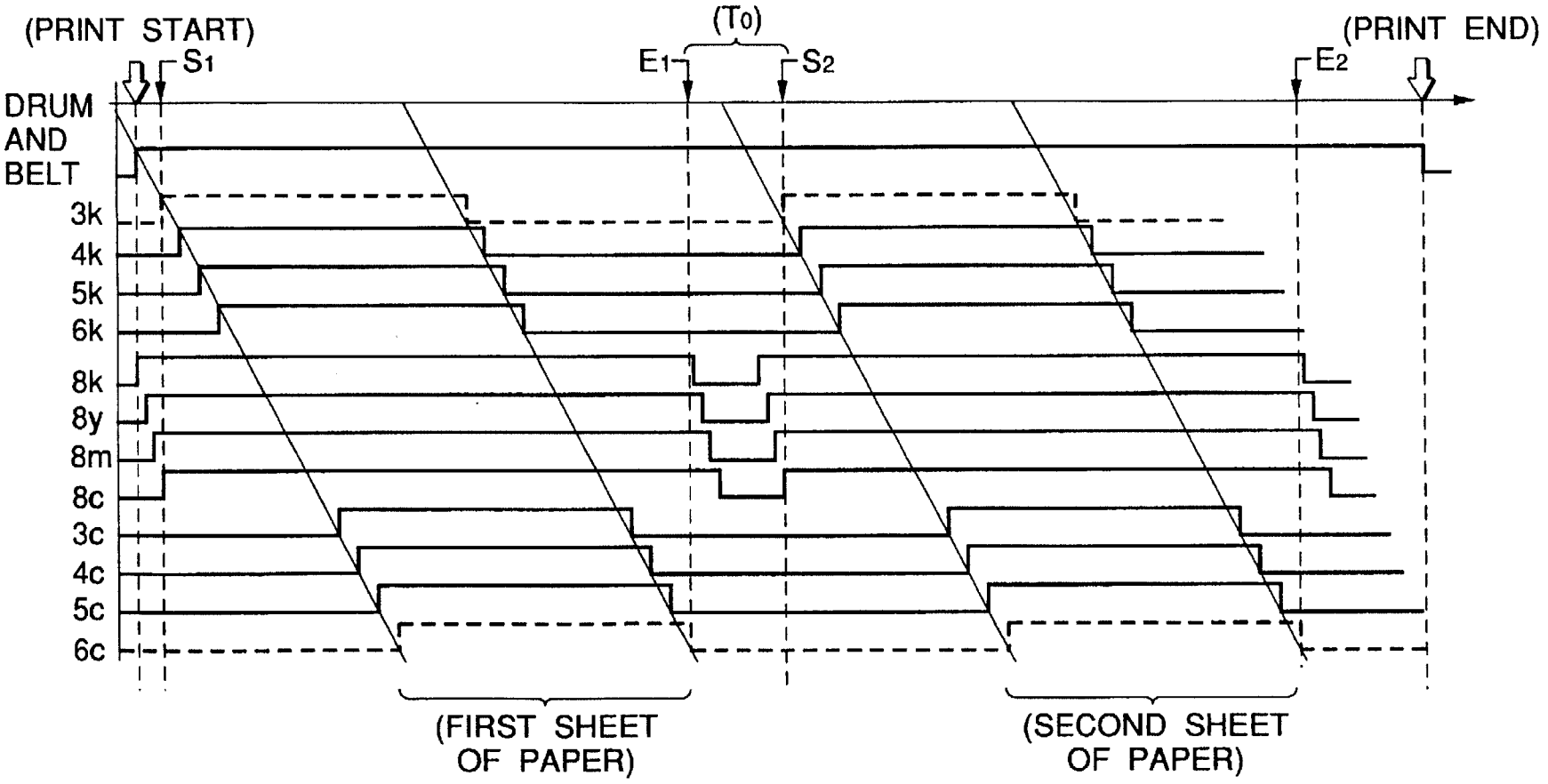
FIG. 34 is a timing chart to show another irregular example of the press means on/off operation timings.

Then, the apparatus of the embodiment performs the on/off operation of the transfer baffles 8 at the following timings: FIG. 32 is a timing chart for explaining the on/off operation timings. The on/off operation timings shown in FIG. 32 are basic setup contents for printing a full color image on one sheet of paper. In FIGS. 32–34, the chart portions concerning second-color (y) and third-color (m) toner image formation and transfer are not shown.

First, the on operation (press operation) of the transfer baffles 7*k*, 7*y*, 7*m*, and 7*c* is performed in the order (k, y, m, c) before the time S when the first-color (k) image exposure unit 3*k* starts writing a latent image, as shown in FIG. 32. The off operation (press release operation) of the transfer baffles 7*k*, 7*y*, 7*m*, and 7*c* is performed in the order (k, y, m, c) after the time E when the last-color (c) transfer step (the operation of the transferrer 6*c*) is complete. In the embodiment, the on operation and the off operation are performed in sequence while the start is delayed by the time of about 100 msec, whereby temporarily excessive power consumption in the apparatus is suppressed and a problem such as an image formation failure caused by voltage drop can be avoided.

To print a full color image continuously, the on/off operation timings of the transfer baffles 8 are set as shown in FIGS. 33 and 34. FIG. 33 is a timing chart for continuously printing a full color image on two continuously fed sheets of transfer material (namely, continuously attracting two sheets of transfer material P on preceding and following holding areas on the transport belt 10). FIG. 34 is a timing chart for continuously printing a full color image on two intermittently fed sheets of transfer material (namely, attracting two sheets of transfer material P on preceding and following holding areas with a 1-sheet or more holding area between on the transport belt 10).

As shown in FIG. 33, to continuously print a full color image on two continuously fed sheets of transfer material, the on operation is performed in the order of k, y, m, c before the time S1 when first-color (k) latent image writing onto the first sheet is started; the off operation is performed in the order of k, y, m, c after the time E2 when the last-color (c) transfer step onto the second sheet rather than the first sheet is complete. Since first-color (k) latent image writing onto the second sheet is already started (S2) at the time El when the last-color (c) transfer step onto the first sheet is complete, the off operation of the transfer baffle 7 should not be performed at the time E1 for the purpose of avoiding occurrence of poor image quality, etc.

On the other hand, as shown in FIG. 34, to continuously print a full color image on two intermittently fed sheets of transfer material, if reasonable idle time TO exists between the time E1 when the last-color (c) transfer step onto the first sheet is complete and the time S2 when first-color (k) latent image writing onto the second sheet is started, the off operation is once performed in the order of k, y, m, c at the time after the time E1 and the on operation is again performed in the order of k, y, m, c at the time before the time S2. That is, if idle time T0 exists between the time E1 when the last-color transfer step onto the first sheet is complete and the time S2 when first-color latent image writing onto the second sheet is started, preferably the on/off operation of the transfer baffles 8 is performed aggressively for eliminating unnecessary contact time of the transport belt 10 and the photosensitive drums 1 as much as possible, thereby preventing transfer baffle wear caused by the sliding friction with the transfer belt 10, transfer of fixer oil, etc., deposited on the transport belt 10 to the photosensitive drums 1, etc.

Of course, also in continuous printing in such a intermittent state, the first on operation is performed in sequence before the time S1 when first-color latent image writing onto the first sheet is started and the last off operation is performed in sequence after the time E2 when the last-color transfer step onto the second sheet is complete.

The effect of on/off operation timing setting of the transfer baffles 8 can be produced particularly in the color image formation apparatus with a plurality of photosensitive drums arranged in the downstream area of the transfer material transport belt 10 in the rotation direction of the drive roll 11 as in the embodiment.

For the transfer material transport belt 10, generally the belt area upstream in the rotation direction of the drive roll (in the embodiment, the side where the electricity removers 19 are placed) is placed in a comparatively tensional state when the belt is turned; the belt area downstream in the rotation direction of the drive roll (in the embodiment, the side where the photosensitive drums, etc., are placed) sags slightly as compared with the upstream area. Thus, there is a high possibility that the sag in the downstream area of the transfer material transport belt 10 slightly sagging will be promoted and the belt behavior will become prone to change at the on/off operation time of the transfer baffles 8, resulting in occurrence of poor image quality. Therefore, in the apparatus with the photosensitive drums placed in the downstream area of the transfer material transport belt 10, the on/off operation of the transfer baffles at the timings as described above becomes extremely effective from the viewpoint of prevention of occurrence of poor image quality, etc.

As we have discussed, according to the invention, an image formation apparatus can be provided which has a cleaning member having both capabilities of efficiently capturing suspended substances deposited on the inner face of the endless belt member and sufficiently holding the deposited suspended substances and can prevent an image defect or a running failure of the endless belt member caused by deposition of the suspended substances on the inner face of the endless belt member.

According to the invention, electricity removal is executed in portions outside the image formation area in the width direction of the transfer material transport dielectric belt formerly not electricity-removed by belt electricity removal means. Such electricity removal is executed before the main electricity removal step of the belt electricity removal means or in addition, is also executed after the main electricity removal step, so that an apparatus malfunction caused by the electrostatic effect in the transfer material transport belt transporter and a poor image can be reliably prevented.

According to the invention, even if an area having a different electrostatic characteristic existing on the transfer belt, such as the seam part or the recording sheet gripper, comes in contact with a photosensitive body and a special potential history occurs on the photosensitive body, the potential unevenness correction means removes the potential history on the photosensitive body caused when the photosensitive body came in contact with the area. Therefore, the photosensitive body can also be set to a uniform charge potential in the next toner image formation cycle; a horizontal stripe corresponding to the area having a different electrostatic characteristic existing on the transfer belt can be suppressed and high-grade, high-quality record images can be formed.

According to the invention, since the press operation of a plurality of the press means and the releasing operation are performed at the timings as described above, vibration occurring at the operation time and poor image quality caused by brake action, etc., can be reliably prevented. Moreover, since the press operation of the press means is performed in sequence at intervals over time, not only poor image quality caused by behavior change of the transfer material transport body easily occurring when the press operation is performed at the same time, but also poor image quality, etc., caused by voltage drop because of excessive power consumption at the operation time can be prevented.

If the press operation of a plurality of the press means and the release operation are performed in order starting at the press means for the first color and ending with the press means for the last color, behavior change of the transfer material transport body that can occur at the operation can be prevented more reliably as compared with the case where the press operation and release operation are performed in the reverse order (starting at the press means for the last color and ending with the press means for the first color). Particularly the release operation is performed in the order starting at the press means for the first color and ending with the press means for the last color, whereby the release operation of the press means for the last color is performed at the point in time where the transfer material after the transfer end of the last color is distant from the corresponding transfer position (of the press means) as much as possible, thus a problem that an unfixed toner image transferred onto the transfer material is disturbed due to vibration, etc., occurring at the release operation time can be avoided. Therefore, if the press operation of the press means and the release operation are performed in order starting at the press means for the first color and ending with the press means for the last color, the prevention effect of poor image quality, etc., described above can be produced more reliably.

What is claimed is:

1. An image formation apparatus for forming an image comprising:

an endless belt member, and an inner face cleaning member which is provided on an inner face of said endless belt member, and has both a function of capturing deposits deposited on the inner face of said endless belt member and a function of holding the captured deposits, said inner face cleaning member including fibers densely arranged and projecting radially outward from said inner face cleaning member, said inner face cleaning member having a contact face adapted to contact said endless belt member, and said inner face cleaning member fixed in a contact state so that said contact face does not move while said endless belt is moving.

2. The image formation apparatus of claim 1, wherein said inner face cleaning member is held in an electric float state from said endless belt member.

3. An image formation apparatus comprising:

an image support, a transfer material support member placed on and transported by a plurality of rollers and coming in contact with said image support in moving, means for transferring a toner image formed on said image support to a transfer material on said transfer material support member, means for removing electricity of said transfer material support member, and an inner face cleaning member being provided on an inner face of said transfer material support member and having both a function of capturing deposits deposited on the inner face of said transfer material support member and a function of holding the captured deposits, wherein said inner face cleaning member is positioned downstream in a move direction of said electricity removal means of said transfer material support member and near upstream of the roller with which said transfer material support member first comes in contact after said electricity removal means.

4. The image formation apparatus of claim 3, wherein said inner face cleaning member includes fibers densely arranged and projecting radially outward from said inner face cleaning member.

5. The image formation apparatus of claim 3, wherein said inner face cleaning member is fixed in a contact state so that a contact face does not move while said transfer material support member is moving.

6. The image formation apparatus of claim 3, wherein said inner face cleaning member is held in an electric float state from said transfer material support member.

7. The image formation apparatus of claim 3, wherein said inner face cleaning member has a plurality of work faces and is held so that the work faces for said transfer material support member can be changed at predetermined intervals.

8. An image formation apparatus comprising:

an image support, a transfer material support member placed on and transported by a plurality of rollers including a drive roller and coming in contact with said image support in moving, means for transferring a toner image formed on said image support to a transfer material on said transfer material support member, means for removing electricity of said transfer material support member, a surface cleaning member for cleaning a surface of said transfer material support member, and an inner face cleaning member being placed on an inner face of said transfer material support member and having both a function of capturing deposits deposited on the inner face of said transfer material support member and a function of holding the captured deposits, wherein said drive roller is located at a position along the transfer material support member after passage through said electricity removal means and after passage through said inner face cleaning member and after passage through said surface cleaning member.

9. The image formation apparatus of claim 8, wherein said inner face cleaning member includes fibers densely arranged and projecting radially outward from said inner face cleaning member.

10. The image formation apparatus of claim 8, wherein said inner face cleaning member is fixed in a contact state so that a contact face does not move while said transfer material support member is moving.

11. The image formation apparatus of claim 8, wherein said inner face cleaning member is held in an electric float state from said transfer material support member.

12. The image formation apparatus of claim 8, wherein said inner face cleaning member has a plurality of work faces and is held so that the work faces for said transfer material support member can be changed at predetermined intervals.

13. An image formation apparatus for forming an image comprising:

an endless belt member, and an inner face cleaning member which is provided on an inner face of said endless belt member, and has both a function of capturing deposits deposited on the inner face of said endless belt member and a function of holding the captured deposits, wherein said inner face cleaning member has a plurality of work faces and is held so that the work faces for said endless belt member can be changed at predetermined intervals.

* * * * *